US009016788B1

(12) United States Patent
Pollard et al.

(10) Patent No.: US 9,016,788 B1
(45) Date of Patent: Apr. 28, 2015

(54) LIFT CHAIR AND RECLINER

(71) Applicant: Golden Technologies, Inc., Old Forge, PA (US)

(72) Inventors: W. Edward Pollard, Falls, PA (US); James Olcheski, Duryea, PA (US)

(73) Assignee: Golden Technologies, Inc., Old Forge, PA (US)

( * ) Notice: Subject to any disclaimer, the term of this patent is extended or adjusted under 35 U.S.C. 154(b) by 0 days.

(21) Appl. No.: 13/851,043

(22) Filed: Mar. 26, 2013

Related U.S. Application Data

(63) Continuation of application No. 12/467,024, filed on May 15, 2009, now Pat. No. 8,403,409, which is a continuation of application No. 11/225,628, filed on Sep. 13, 2005, now Pat. No. 7,543,885.

(60) Provisional application No. 60/609,415, filed on Sep. 13, 2004.

(51) Int. Cl.

| | |
|---|---|
| ***A47C 13/00*** | (2006.01) |
| ***A47C 1/0355*** | (2013.01) |
| ***A47C 1/035*** | (2006.01) |

(52) U.S. Cl.
CPC ..... *A47C 1/0355* (2013.01); *A47C 1/035* (2013.01)

(58) Field of Classification Search
USPC ..... 297/85 M, 330, 69, 362.11, 344.12, 297/344.15, 344.17
See application file for complete search history.

(56) References Cited

U.S. PATENT DOCUMENTS

| | | | | |
|---|---|---|---|---|
| 6,659,556 | B2 * | 12/2003 | Pellerin | 297/330 |
| 6,726,276 | B1 * | 4/2004 | Tholkes et al. | 297/172 |
| 6,840,575 | B2 * | 1/2005 | Hesse | 297/85 M |
| 6,846,042 | B2 * | 1/2005 | Hanson et al. | 297/411.36 |
| 7,543,885 | B2 * | 6/2009 | Pollard et al. | 297/85 R |
| 8,403,409 | B2 * | 3/2013 | Pollard et al. | 297/85 M |

* cited by examiner

*Primary Examiner* — David R Dunn
*Assistant Examiner* — Alexander Harrison
(74) *Attorney, Agent, or Firm* — Clinton H. Wilkinson; Charles A. Wilkinson

(57) ABSTRACT

A combination lift chair and reclining chair having additional seating and reclining positions is provided with two separate motors and linkages enabling the chair back to be independently placed in various positions and the seat separately movable with the footrest and elevated once the footrest has reached full deployment using the same motor.

23 Claims, 30 Drawing Sheets

LIFT CHAIR AND RECLINER

CROSS-REFERENCE TO PREVIOUS RELATED APPLICATION

This application is a continuation of U.S. Utility application Ser. No. 11/225,628 which claims the benefit of U.S. Provisional Patent Application Ser. No. 60/609,415, filed on Sep. 13, 2004.

BACKGROUND OF THE INVENTION

1. Field of the Invention

The present invention relates to chairs in general, and more particularly to recliner chairs and lift chairs, and more particularly still to a recliner or lift chair wherein the back frame is movable independent of the seat frame and footrest, and can be positioned in both a zero gravity and Trendelenburg position.

2. Preliminary Discussion

Recliner chairs and lift chairs have been on the market for years, with the utility of recliners being primarily for use in living rooms and family rooms, while lift chairs are used by the handicapped, elderly, or disabled to assist them in moving from a reclined or sitting position to a standing position. While a substantial number of today's recliners are still manually operated, a growing number of recliners, and almost all lift chairs, utilize one or more actuators to move the footrest, back frame, and seat frame into various positions with respect to each other including reclining positions within a specified range, as well as to physically lift the chair while tipping it forward to aid the occupant to stand up. In one known chair type, independent movement of the footrest and backrest is accomplished through the use of separate actuators, while other chairs utilize a single interconnected actuator to cause the footrest and backrest to move together or simultaneously. In the past, in those recliner chairs in which the back frame is movable independent of the position of the seat frame or footrest, the back frame actuator has been connected between the back frame and either the chair frame or lift frame. Unfortunately, the range in which the back frame can be pivoted or moved without being impeded or obstructed by other parts or components of the chair, such as the chair frame, lift frame actuator, or seat frame, is rather limited, depending upon the particular lift or recline position the chair is in. In other words, despite the use of a separate chair back actuator, the position of the back frame is still limited.

In addition to the usual television watching and other relaxing positions, a few known chairs can also be moved or pivoted into certain special positions. One of these is the so-called Trendelenburg position, wherein the occupant's legs are situated so that they are higher in relation to the ground than the heart. This position is useful particularly for those having certain circulatory, kidney, or other ailments, since in such position gravity assists the flow of blood from the legs back to the heart. Another special position is the so-called "zero gravity" or 90/90 position. To achieve such position, the chair is moved so that the head and torso are at a slight upward angle, the legs up to the knee are bent at a similar opposite upward angle, and the knees are bent so that the lower area of the legs is angled similarly to the torso. The zero-gravity position approximates the position or posture that astronauts assume when sleeping in a weightless environment. The primary benefit of such position is reduced pressure on the spine, which often relieves back pain at least to some extent. Other benefits include reduced heart stress, relief of tension in the body, and improved circulation. So far as the inventors are aware, no prior art motor actuated lifts chairs or recliners can achieve both the Trendelenburg and zero-gravity positions as well as independent movement of the back frame relative to the seat frame and footrest.

It has now been discovered that by securing the actuator for moving the back frame independently of the lift frame and footrest between the back frame and the seat frame in such a manner that such actuator can move along with or relative to the seat, and by providing a unique linkage mechanism, when the actuator for moving the footrest is utilized, the seat frame can also be simultaneously moved to any position the recliner mechanism is capable of providing without interfering or coming into contact with the actuator for moving the back frame or any other parts of the chair. Thus, in one embodiment, as the footrest is moved upwardly, the back frame will move rearwardly at the same time until the footrest is in a substantially horizontal position. Then, if one tries to move the footrest beyond such substantially horizontal position, the footrest as well as the back frame will both move together in a generally upward direction. At the same time, the back frame can be moved independently of the footrest and seat frame using its own actuator. If such an arrangement is provided on a combination recliner and lift chair, the actuator for the footrest and seat frame will be moved to a closed position and then continue beyond such position until the frame of the chair is lifted upwardly and tilted forwardly by the lift assembly. By arranging the actuators in such a manner, the chair can provide multiple positioning of the occupants or user ranging from the Trendelenburg position to various recline and lift positions. Such arrangement also enables the footrest, back frame, and seat to move together if desired, while moving the footrest and seat together, with the seat moving rearwardly, allows the seat be articulated up at an angle which is comfortable and puts the occupant in a so-called "zero gravity" or back relief position, which provides complete support for the occupant and takes pressure off the spine. A size-adjustable stop is also used to alter slightly the final angle of the footrest in relation to the seat frame.

3. Description of Related Art

The prior art evidences multiple chairs consisting of known and expected structural configurations designed to move between a reclined position, a sitting position, and a lift position wherein the occupant is enabled more easily to assume a standing or upright position, as well as a wide range of alternative designs that have been developed to fulfill countless specific objectives and requirements. The following patent documents are illustrative of the present state of this field.

U.S. Pat. No. 3,016,264 issued to A. L. Hughes on Jan. 9, 1962, entitled "Motor-Operated Reclining Chair", discloses a recliner wherein the backrest (22) is pivotally mounted to the side arms of the chair, and is movable by a drive mechanism (72). However, the drive mechanism is connected between the chair frame and a pair of arm members that comprise part of the main support structure of the chair, rather than between the chair and seat frames, and therefore suffers from the disadvantage of having a limited range of motion.

U.S. Pat. No. 3,743,348 issued to C. J. Sloan on Jul. 3, 1973, entitled "Reclining Chair and Mechanism Therefore", discloses a recliner assembly wherein in one embodiment, illustrated in FIG. 8, dual motors are provided, with motor 120 being used to pivot the back frame, while motor 126 is used to deploy the footrest. Back frame motor 120, however, appears to be connected between the chair plate and back plate, so that while the position of the back is movable independently of the position of the leg rest, it is not movable independently of the position of the seat frame in the same manner as the present invention, which as a result can achieve a wider range of reclining positions.

U.S. Pat. No. 4,007,960 issued to E. J. Gaffney et al. on Feb. 15, 1977, entitled "Reclining Elevator Chair", discloses a lift-recliner chair in which while movable to a substantially fully reclined position, the back frame appears to be movable with respect to the seat only when the entire chair is being moved to a reclined position, rather than moved independently of the position of the seat frame and footrest.

U.S. Pat. No. 4,365,836 issued to W. R. Jackson et al. on Dec. 28, 1982, entitled "Motorized Reclining Chair", discloses a recliner chair having a single motor or actuator. While the linkage system for such chair enables it to be moved to a conventional television viewing position and a resting position, there is no means for changing the position of the backrest independently of the position of the seat frame or footrest.

U.S. Pat. No. 4,386,803 issued to C. W. Gilderbloom on Jun. 7, 1983, entitled "Motorized Reclining Chair", discloses a recliner wherein the chair back, seat, and leg rest are claimed to be independently adjustable, and in addition an adjustable head supporting means is provided. As shown in FIG. 1, while such chair appears to be capable of attaining a wider than usual range of reclining positions the arrangement of the motors and linkage mechanism are unlike the simplified arrangement of the present invention.

U.S. Pat. No. 4,852,939 issued to B. J. Krauska on Aug. 1, 1989, entitled "Device for Converting a Recliner Chair to a Recliner-Lift Chair", discloses a base that when connected to a conventional recliner turns it into a power actuated recliner and lift chair. The back frame, however, is not independently movable, and therefore the number of reclining positions that can be achieved with such chair are substantially limited.

U.S. Pat. No. 5,013,084 issued to T. J. May on May 7, 1991, entitled "Mechanism for High-Leg Reclining Apparatus", discloses a dual legrest type recliner chair capable of attaining an upright, TV, and fully reclined position. The linkage of the chair back frame to the seat frame does not allow for independent movement of the chair back, however.

U.S. Pat. No. 5,165,753 issued to E. D. Henderson on Nov. 24, 1992, entitled "Elevator Chair Apparatus" discloses a lift chair wherein the sub-frame pivots on a base portion having a rearwardly inclined upper surface. In a lift position, the sub-frame pivots on the front edge of the inclined surface via an actuator. U.S. Pat. No. 5,520,439 issued to E. D. Blount on May 28, 1996 entitled "Fully Reclinable Elevator Lift Chair", discloses a lift-recliner chair that is an improvement on the Henderson '753 chair in that it can also be moved to a fully reclined position, while the Henderson chair cannot. The actuator in Blount is connected between the base and a pivotable transverse bar on which the back is supported by brackets, so that when the motor ram is moved away from the motor, eventually the bar pivots to cause the back to recline. See also commonly owned continuation-in-part U.S. Pat. No. 5,806,920 entitled "Fully Reclinable Elevator Lift Chair with Ottoman" wherein an elevatable footrest is also provided. None of such arrangements appears to allow for completely independent adjustment of the back frame, however.

U.S. Pat. No. 5,265,935 issued to G. Geisler et al. on Nov. 30, 1993, entitled "Stand-Assist Recliner Chair", discloses a lift-recliner wherein the actuator is secured between two separate crank arms under the chair seat. The linkage mechanism used, however, does not appear to provide the same maneuverability of the back section recliner as is possible with the present inventors' arrangement.

U.S. Pat. No. 5,312,153 issued to J. Lin on May 17, 1994, entitled "Recline Lift Wall Hugger Chair", discloses an arrangement for enabling a chair to pivot forwardly, or away, from a wall when it is to be moved into a reclining position. In the embodiment shown in FIGS. 12-14, the backrest is tiltable relative to the seat using a crank arm connection arrangement between the backrest and seat. However, the seat still must move forwardly for the back to move to a fully reclined position, and there is no means for independently pivoting the backrest with respect to the seat portion.

U.S. Pat. No. 5,354,116 issued to T. J. May et al. on Oct. 11, 1994, entitled "Reclining Chair with Articulating Linkage for Padded Intermediate Ottoman", discloses a recliner having a linkage mechanism connecting the legrest, seat, and backrest. The linkage system does not provided for independent movement of the backrest, however.

U.S. Pat. No. 5,498,055 issued to P. R. Goldman on Mar. 12, 1996, entitled "Recliner: Apparatus and Method", discloses a recliner wherein the user's feet are elevated above his or her heart in a fully reclined position. As shown in FIG. 2, the entire chair can pivot about an axis (21) in relation to the chair frame (13), while the seat and back as well as the seat and footrest are also independently pivotable with respect to one another, so that numerous reclined positions are possible, one of which is to have the footrest raised upwardly so that the user's feet are above his or her heart. A means for automatically moving the footrest when the backrest is rotated is also provided. While the Goldman recliner therefore can be moved into a Trendelenburg position, this is accomplished in a completely unique manner unlike the present invention, and it is unclear whether a bed-like position can be reached.

U.S. Pat. No. 5,582,457 issued to K. J. Komorowski et al. on Dec. 10, 1996, entitled "Dual Leg Rest Assembly", discloses a linkage assembly for a legrest wherein coordinated movement of first and second leg rest panels, i.e., a dual legrest, is provided. A separate linkage means for tilting the backrest is also shown, but the back frame is not movable via a power actuator means.

U.S. Pat. No. 5,651,580 issued to L. P. LaPointe et al. on Jul. 29, 1997, entitled "Linear Actuation Drive Mechanism for Power-Assisted Chairs and Base Therefor", discloses a lift-recliner chair that utilizes a single linear action drive mechanism to selectively actuate the reclining linkage assembly, footrest linkage assembly, and the lift and tilt assembly. Such chair, which is the subject of several related patents, does not appear to disclose a motor actuated system for independently adjusting the position of the backrest.

U.S. Pat. No. 6,000,758 issued to W. E. Schaffner et al. on Dec. 14, 1999, entitled "Reclining Lift Chair", discloses a chair having a novel linkage mechanism system for lifting and reclining in which when a bell crank is pivoted in a clockwise direction by an actuator, the chair back is caused to recline, and in addition having an environmental control system. There does not appear to be a means for independently adjusting the position of the chair back with respect to the chair seat frame in any of the disclosed embodiments, however, so that the range of positions in which the chair can be reclined is limited in comparison to the present invention.

U.S. Pat. No. 6,022,076 issued to I. Samson on Feb. 8, 2000, entitled "Reclinable Seating", discloses a recliner chair in which the center of gravity of the reclining unit remains in a horizontal plane as it moves between an upright and reclined position, thereby increasing the stability of such chair in these positions. While the Samson recliner appears to possibly be movable to a zero-gravity position, such chair does not disclose any of the unique features of the present invention.

U.S. Pat. No. 6,135,559 issued to J. R. Kowalski on Oct. 24, 2000, entitled "Seat Back Reclining Mechanism Adaptable to Chairs with Stationary or Movable Seats", discloses a recliner that includes a linkage mechanism for pivoting the seat back independent of and without regard to the position of the seat. However, movement of the back is initiated by manual force against the chair back and against the force of a coil spring, rather than utilizing a power actuator to move the seat, and the number of reclined positions is limited in comparison to the present invention.

U.S. Pat. No. 6,142,558 issued to T. J. May on Nov. 7, 2000, entitled "Recliner with Primary and Secondary Ottomans", discloses a "low leg" recliner chair having a unitary linkage arrangement for the chair legrest, seat, and back. The May chair is not motor actuated, however, and the backrest appears to pivot in unison with the seat, rather than completely independent of the seat movements as in the present invention.

U.S. Pat. No. 6,213,554 issued to Y. Marcoux et al. on Apr. 10, 2001, entitled "Lift Chair", discloses a lift chair mechanism for a lift chair having a chair frame that can be reclined independently of the lift mechanism and base frame, as well as providing for a rocking motion. The chair back cannot be reclined independent of the seat frame, however.

U.S. Pat. No. 6,840,575 issued D. Hesse on Jan. 11, 2005, entitled "Seat-Recliner Fitting That Can be Adjusted by a Motor", discloses a fitting for adjusting the inclination of a seat back and a footrest of a recliner using separate actuators. While such arrangement appears to enable the backrest to be moved independently of the position of the seat portion, the specification nevertheless indicates that the seat is moved forward at the same time the back is moved. In addition, the linkage mechanism on which the seat is pivoted is unlike that of the present lift-recliner chair, and the use of an adjustable size spacer for microadjustment of the angle of the footrest in a fully reclined position is also not disclosed.

German Gebrauchmuster Patent Application DE 9420149.8 filed by W. Hoormann et al. on Dec. 16, 1994, discloses according to in FIGS. 1 and 2, a recliner having a pair of actuators or motors, one of which is connected to the backrest. However, such motor appears to be connected on its other end to the chair frame rather than the seat, and therefore would not provide the same advantages available in the present disclosure.

U.K. Patent Application 2,030,854 published on Apr. 16, 1980, entitled "Reclining Chair", discloses a recliner wherein the seat and back are pivotally connected to the base as well as to each other. When the back pivots, the seat also must pivot, so that there does not appear to be a means for pivoting the seat independently of the back.

U.K. Patent Application No. 2,407,493 published on Apr. 5, 2005 entitled "Powered Lift Reclining Chair", discloses a lift-recliner chair having an actuator for pivoting the back portion with respect to the seat portion, as well as the seat portion with respect to the base portion. The actuators are substantially enclosed within the base portion of the chair at all positions of the chair, which arrangement reduces the risk of entrapment and injury during movement of the chair (as shown in FIGS. 2 and 3). It is indicated that the actuator for moving the back portion is "fixed" relative to the seat portion. As shown in FIG. 2, however, actuator (66) is mounted to base frame cross member (26) on one end and the actuator arm (67) is mounted to cross member (60), not the seat frame.

While the aforementioned prior art devices fulfill their respective, particular objectives and requirements, they do not disclose a lift or recliner chair having the particular capabilities and advantages of the present invention. The chair according to the present invention substantially departs from the conventional concepts and designs of the prior art, and in doing so provides a lift and recliner chair having an independently operating back and a movement rearwardly and upwardly of the seat to a substantially reclining position as the footrest is activated, that is capable of easily achieving a wider range of reclining positions, including both a Trendelenburg and zero-gravity position.

OBJECTS OF THE INVENTION

It is therefore a primary object of the invention to provide a combination lift chair and reclining chair in which the chair progresses from a sitting position to either a lift position on the one hand or a Trendelenburg position on the other hand.

It is a still further object of the invention to provide a combination lift chair and Trendelenburg chair.

It is a still further object of the invention to provide a combination reclining and lift chair in which the seat lifts in combination with the footrest to provide a raised position that can be varied with various positions of the back to provide multiple resting positions.

It is a still further object of the invention to provide a reclining chair with a larger variety of positions than have been previously available.

It is a still further object of the invention to provide a lift chair with a novel mechanical arrangement for providing a variety of positions for the occupant.

Is a still further object of the invention to provide a lift chair with a superior linkage system and arrangement providing a plurality of resting positions for the occupant as well as a position aiding the occupant to arise from the chair.

It is a still further object of the invention to provide a lift chair which is enabled to have an independently operating back in which the operating motor for the back is anchored to the seat rather than to the frame of the chair or to the lift assembly.

It is a still further object of the invention to provide a lift and reclining chair that can achieve both a Trendelenburg reclined position and a zero-gravity reclined position.

It is a still further object of the invention to provide a spacer means for adjusting slightly the angle of the footrest in a fully reclined position.

It is a still further object of the invention to provide a lift and reclining chair having a independently positionable back frame having a linkage mechanism that is strong and durable and stable enough to withstand repeated use over time.

Still other objects and advantages of the invention will become clear upon review of the following detailed description in conjunction with the appended drawings.

SUMMARY OF THE INVENTION

A novel mechanical arrangement for use with recliner chair or lift chair is provided involving two independently operating actuators or motors secured to the parts of the chair in a novel manner such as to allow a substantial reclining or sitting position in a central position, a Trendelenburg or legs elevated with respect to the heart elevation position on one side of a reclining or sitting position, and a lift position for allowing or aiding the occupant to stand up and leave the chair on the other side or position. By pivotably connecting the operating actuator for the back between the seat frame and back frame, such operating actuator will move as the seat frame is moved and stay in the same general relative position with respect to the seat frame at all times. In addition, a linkage arrangement for accomplishing such independent pivotable movement is also provided, as well as a means for slightly adjusting the angle of the footrest in a fully reclined position, whereby the chair occupant may also adjust the chair to a zero-gravity reclining position. Such mechanical arrangement can be used with any recliner and/or lift mechanism or arrangement and results in an overall more comfortable and versatile recliner.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
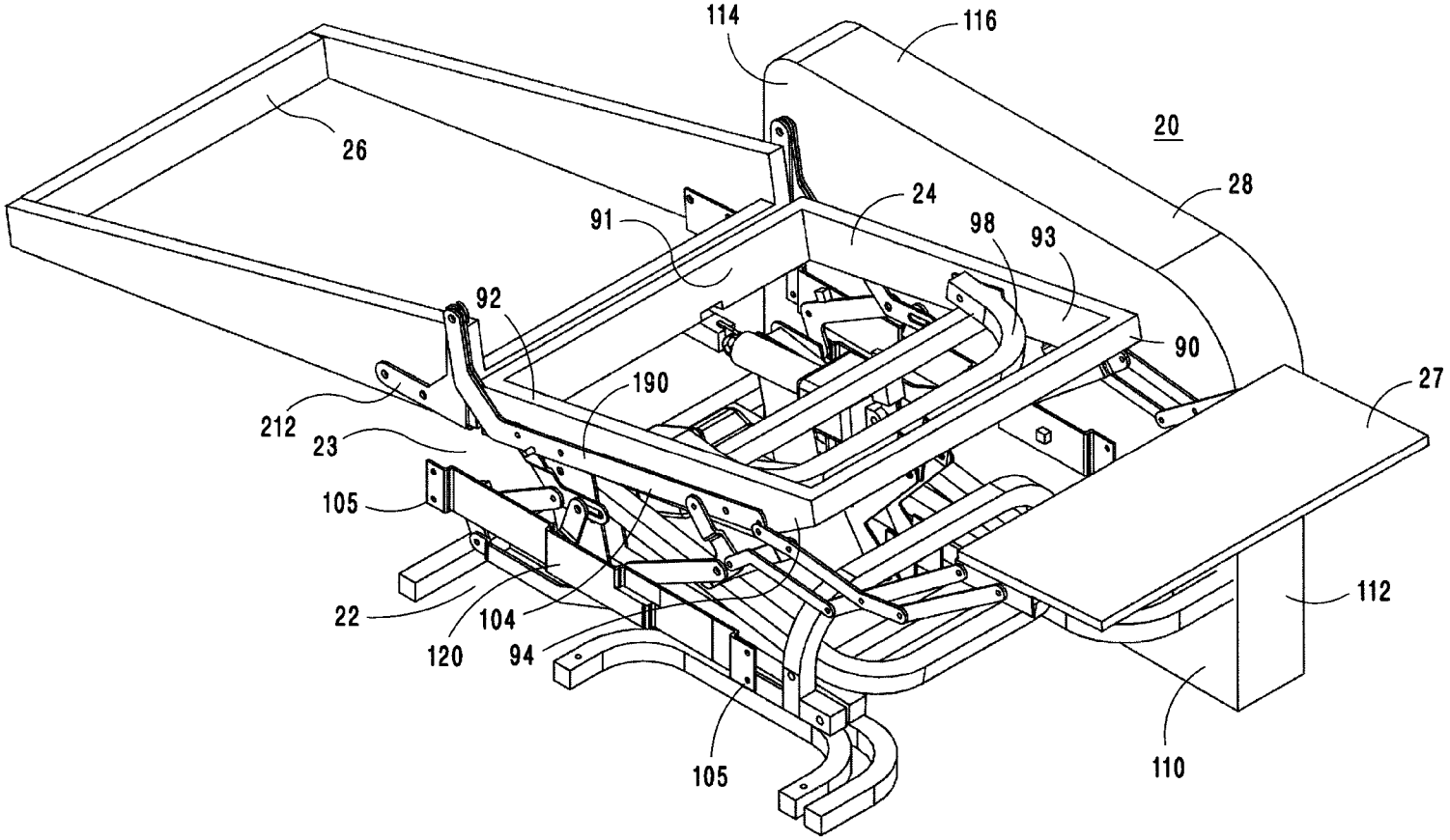
FIG. 1 is a front perspective view of the chair of the invention in a fully reclined position with most of the frame including one of the arm frames and the upholstery removed.
Figure 2:
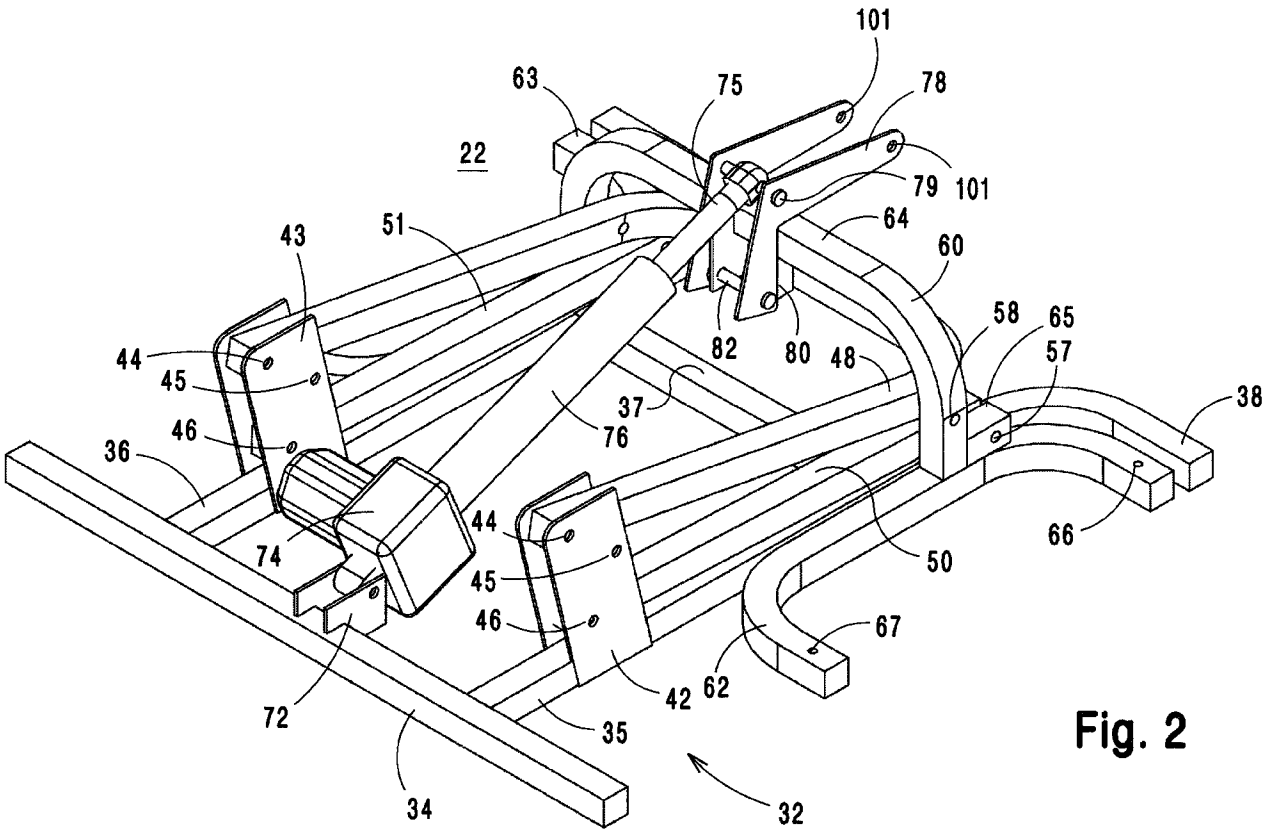
FIG. 2 is an isometric view of the lift frame or assembly of the chair in a retracted position.
Figure 3:
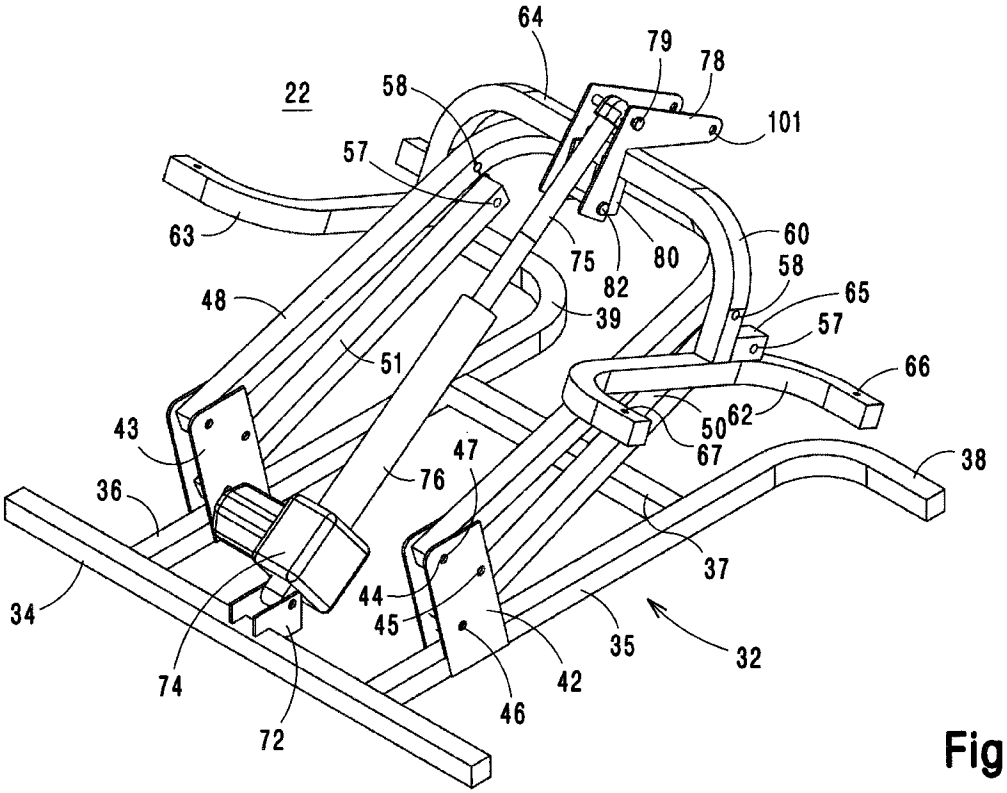
FIG. 3 is an isometric view of the lift frame or assembly of the chair in an extended position.
Figure 13:
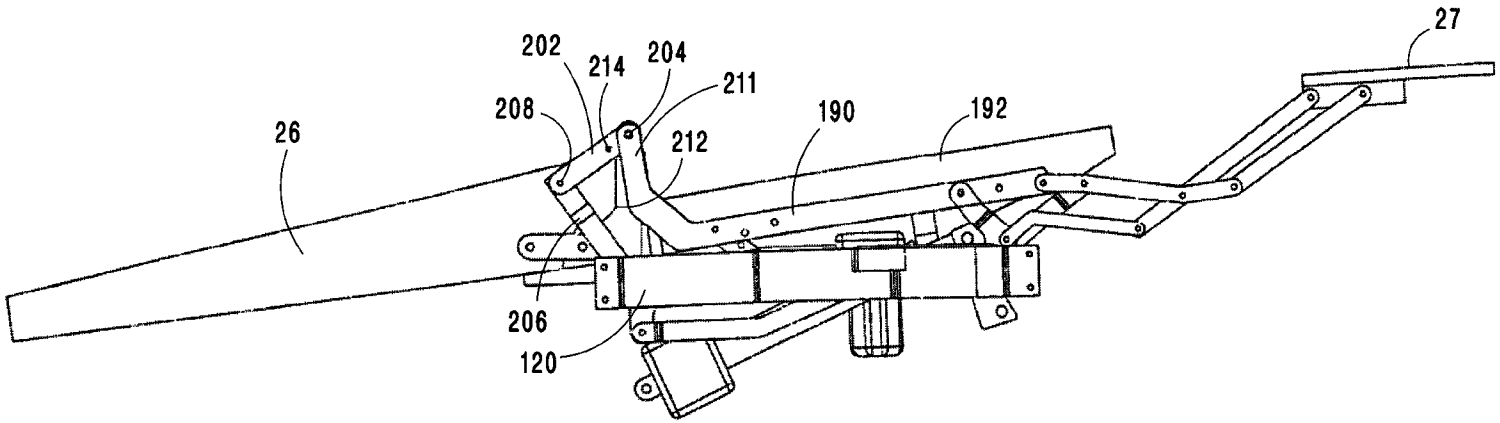
FIG. 13 is a side view showing the chair frame portion of the invention with the seat frame having an alternative preferred attachment assembly, footrest, and back frame portions of the chair of the invention in a reclined position, the seat back motor or actuator and recliner motor or actuator connected, and the recliner mechanism connected.
Figure 14:
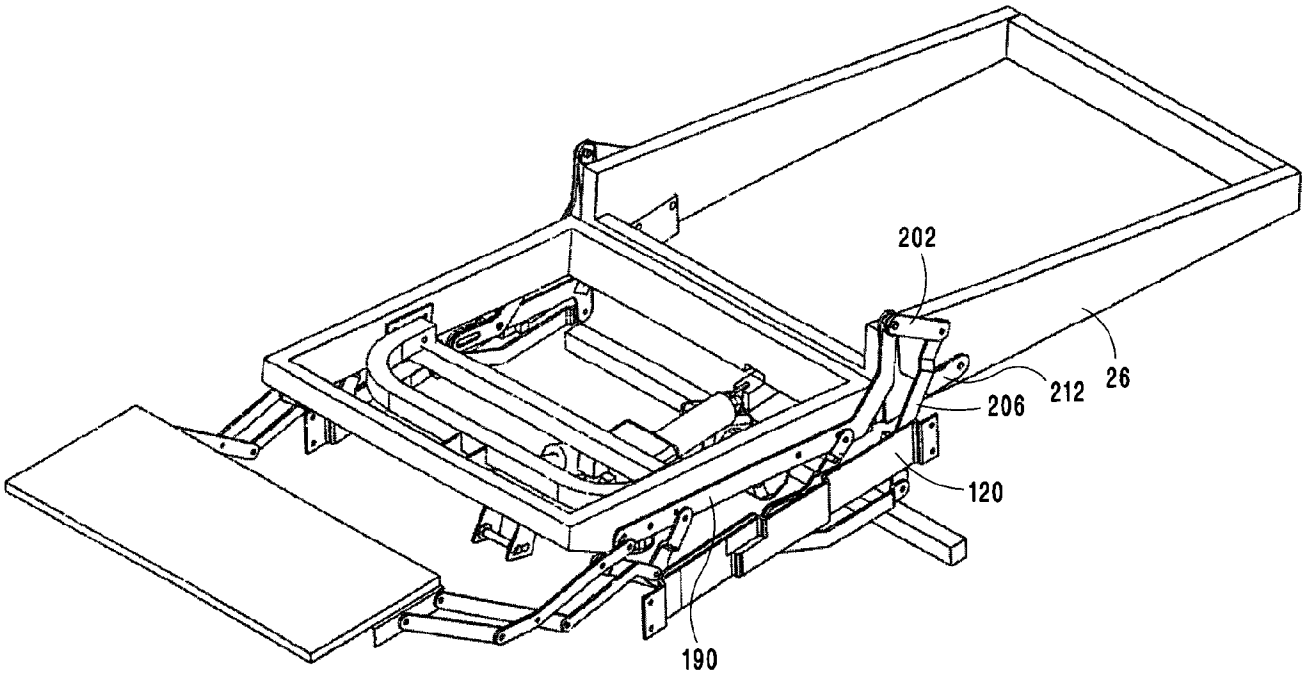
FIG. 14 is a right side perspective view of the chair frame portion of the invention similar to FIG. 13 with the seat frame, footrest, and back frame portions of the chair of the invention in a reclined position, the seat back motor or actuator and recliner motor or actuator connected, and the recliner mechanism connected.
Figure 22:
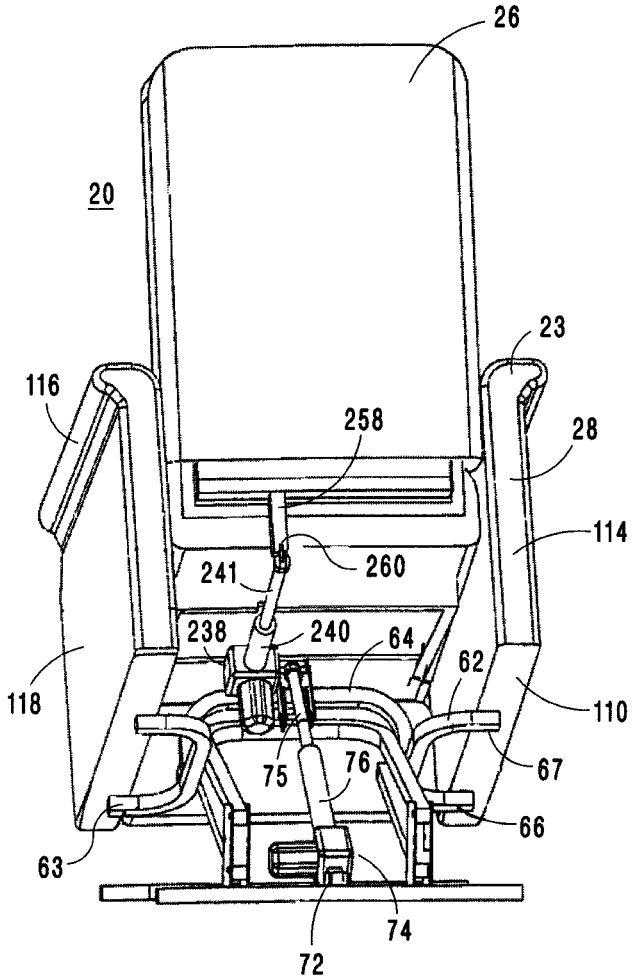
FIG. 22. is a rear view of the chair of the invention having the arm frames and upholstery thereon with the lift mechanism in a raised position.
Figure 23:
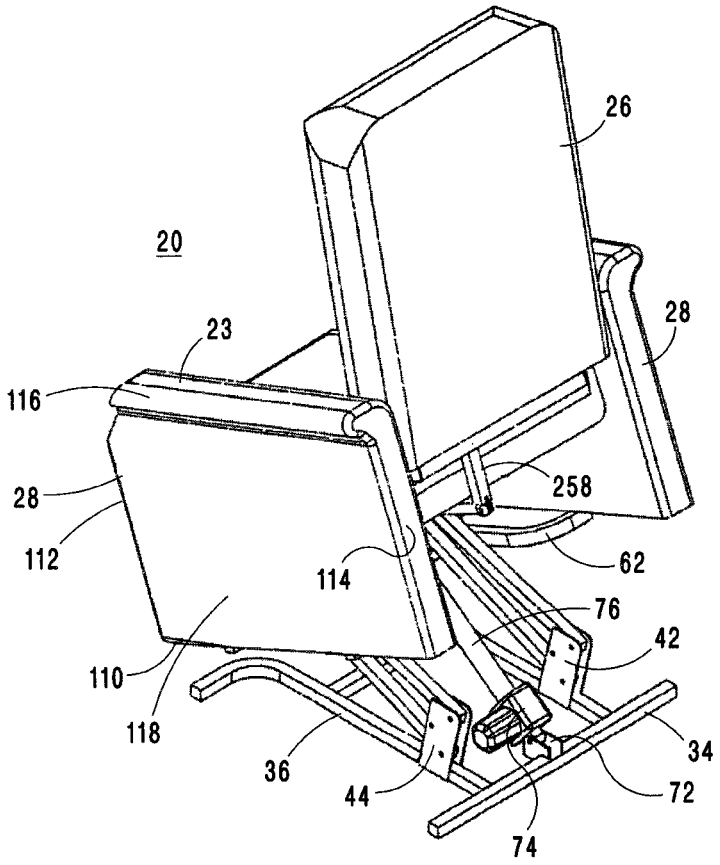
FIG. 23 is a left rear perspective view of the chair of the invention with the lift mechanism in a raised position.

FIGS. 1-12 and 15-24 illustrate a first embodiment of the present invention, FIGS. 13-14 illustrate a second embodiment wherein a preferred chair backframe pivot mechanism is disclosed, and FIGS. 25-28 illustrate another preferred embodiment of such chair backframe pivot mechanism. Referring first to FIG. 1, there is shown a perspective view of chair 20 of the invention in a reclined position, with the right arm frame, from the point of view of a chair occupant, and all of the upholstery removed to illustrate the components of the invention underneath. Chair 20 is comprised of a lift frame or assembly 22, shown in greater detail in FIGS. 2-3, and chair assembly 23 which is attached to lift frame or assembly 22. Chair assembly 23 generally includes seat frame 24, back frame 26, leg or footrest 27, pair of arm frames 28, only one which is shown in FIG. 1, and linkage mechanisms 104. It will be understood that arm frames 28 of chair assembly 23 are usually of a wooden construction and are overall conventional, and one possible embodiment of the wooden chair frame attached to lift frame 22 is shown in FIGS. 22 and 23. As shown in FIGS. 2-3, lift frame 22 includes base frame 32, which is comprised of a rear crossbar 34, spaced apart parallel bars 35 and 36 connected to and extending forwardly from rear crossbar 34, and brace 37 spaced apart from rear crossbar 34 and connecting between bars 35 and 36. Forward ends 38 and 39 of parallel bars 35 and 36 curve outwardly towards the perimeter of the chair, essentially matching the ends of crossbar 34 so that base frame 32 forms a stable base or floor support for chair assembly 23 when it is in a raised or lift position, a normal seated position, or when it is in any number of reclined positions. Foot members (not shown) adjustable or unadjustable and usually padded in some manner may also be attached to the underside of rear crossbar 34 and on the forward ends 38 and 39 of parallel bars 35 and 36, or at any other desired location. Also connected to parallel bars 35 and 36 near rear crossbar 34 are large brackets 42 and 43, respectively, each having apertures 44, 45, and 46 therein to facilitate pivotable attachment to the ends of U-shaped bar member 48 and straight bars 50-51. The ends of U-shaped bar 48 are pivotably connected by pins or pintles 47 extending though apertures 44 in brackets 42 and 43 and corresponding aligned apertures in U-shaped bar 48. Further, straight bar 50 is connected to bracket 42 by a pin or pintle extending through aperture 46 and matching apertures in bar 50, while identical straight bar 51 is connected by a pin or pintle extending through aperture 46 in bracket 43 and matching apertures in bar 51. If it is desired to change the angle of the lift position of the chair slightly, bars 50 and 51 could be secured in apertures 45 rather than apertures 46. Identical short links 54 and 56 (not shown) pivotably connect the upper ends of bars 50 and 51 to U-shaped bar 48 via pins or pintles 57 and 58 extending through apertures in such bars 48 and 50-51, respectively. Such double bar structure gives lift assembly 22 added strength and integrity so that it is sufficiently strong to support the maximum weight of the chair frame plus an occupant of the chair over an extended period of use.

Also pivotably connected to bars 48 and 50-51 on the side opposite links 54 and 56 via pins 57 and 58, respectively, is chair frame support structure 60. Chair frame support structure 60 is comprised of similar outwardly facing C-shaped bar sections 62 and 63 which are connected together by welding to third downwardly facing C-shaped section 64 situated at a right angle to sections 62 and 63. In addition, square bar sections or braces 65 are secured by welding adjacent the connection points of bar sections 62 and 63 and C-shaped section 64 through which the apertures for receiving pins 57 are provided, and serve as strengthening members for support structure 60. The ends of C-shaped bar sections 62 and 63 are secured to the underside of bottom pieces 110 of the arm frames 28 (shown in FIGS. 22 and 23) of the chair frame via screws or the like extending through apertures 66 and 67 in such bars sections. Rear crossbar 34, bars 35 and 36, brace 37, C-shaped bar 48, straight bars 50 and 51, C-shaped sections 62, 63, and 64 of chair frame support structure 60, and brace 65 are all preferably made of hollow rectangular steel bars that are welded together where appropriate. The pins or pintles, as well as brackets 42 and 43, and brackets 72 and 80 (discussed below) are also preferably made of steel and welded to the steel bar structures as appropriate.

Connected spaced from the edges of rear crossbar 34, and preferably between parallel bars 35 and 36, is small bracket 72, to which motor or actuator 74 is pivotably attached by a pin or pintle. Actuator 74 may be any type of actuator including but not limited to electric, gas, and hydraulic actuators. A preferred actuator is an electric motor that relatively rotates an internally threaded sleeve 76 and an externally threaded spindle 75 received therein to increase and decrease their combined overall length, and to thereby adjust the position of objects connected to the end of such threaded sleeve and spindle arrangement. Neither such internal nor exterior threads are visible, but will be understood to be conventional in the art. Suitable actuators are the Omegadrive™ linear actuators commercially available from OkinGmbH & Co. KG located in Gummersbach, Germany, model numbers OS2-SW-394-212 and OZ-SW-330-181. The outer end of externally threaded sleeve 75 is adapted to be pivotably secured to L-shaped bracket or bell crank 78 at a central position by pin or pintle 79 which is passed through matching apertures in the bracket and in the end of sleeve 75. L-bracket 78 is in turn pivotably connected on its downwardly extending flange to small bracket 80, which bracket is secured extending downwardly from C-bar section 64 of chair frame support structure 60 by pin or pintle 82 extending through aligned apertures in L-bracket 78 and small bracket 80. Brackets 72 on crossbar 34 and 80 on chair frame support structure 60 are aligned so that the actuator mechanism extends between such brackets more or less in parallel with bars 50 and 51.

Figure 4:
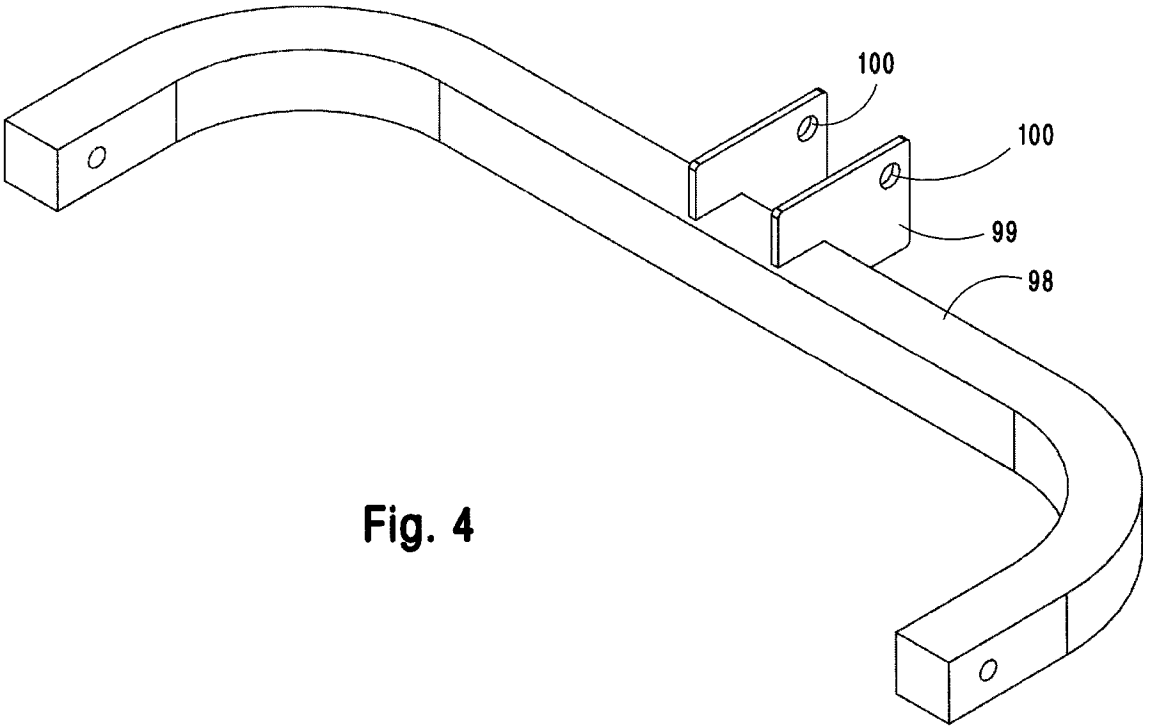
FIG. 4 is an isometric view of the C-shaped bar for pivotably connecting the seat frame and the recliner motor or actuator assembly.

Referring again to FIG. 1, as well as FIGS. 7-10 and 13-21, seat frame 24, back frame 26, and footrest 27, all preferably made of wood, are connected to lift frame assembly 22 as follows. Seat frame 24 is comprised of front member 90, rear member 91, and side members 92 and 93, which members are stapled, nailed, or otherwise secured together such as by threaded fasteners or the like to form a rectangular frame or separate frames connected together. The underside of side members 92 and 93 is tapered toward front member 90 at 94 in the present embodiment to allow room for recliner linkage mechanisms 104, shown detached from chair 20 in FIGS. 5 and 6. Recliner mechanisms 104 pivotably connects the seat frame 24, back frame 26, and footrest 27 together, as described below, as well as to chair frame 28, resulting in an interconnected whole mechanism. In addition, C-shaped bar 98, shown attached to seat frame 24 in FIG. 1 and detailed in FIG. 4, is pivotably connected extending between side members 92 and 93 of seat frame 24 approximately one-third of the way from front member 90. Bracket 99 is connected by welding to C-shaped bar 98 (see FIG. 4) at a position aligned with L-shaped bracket 78, with apertures 100 therein being aligned with apertures 101 in L-bracket 78 (see FIGS. 2 and 3), and pivotably connected thereto by a pin or pintle (not shown) such that expansion lengthening or shortening of actuator 74 is transmitted through bell crank to C shaped bar 98 and hence to the seat structure 24.

Figure 5:
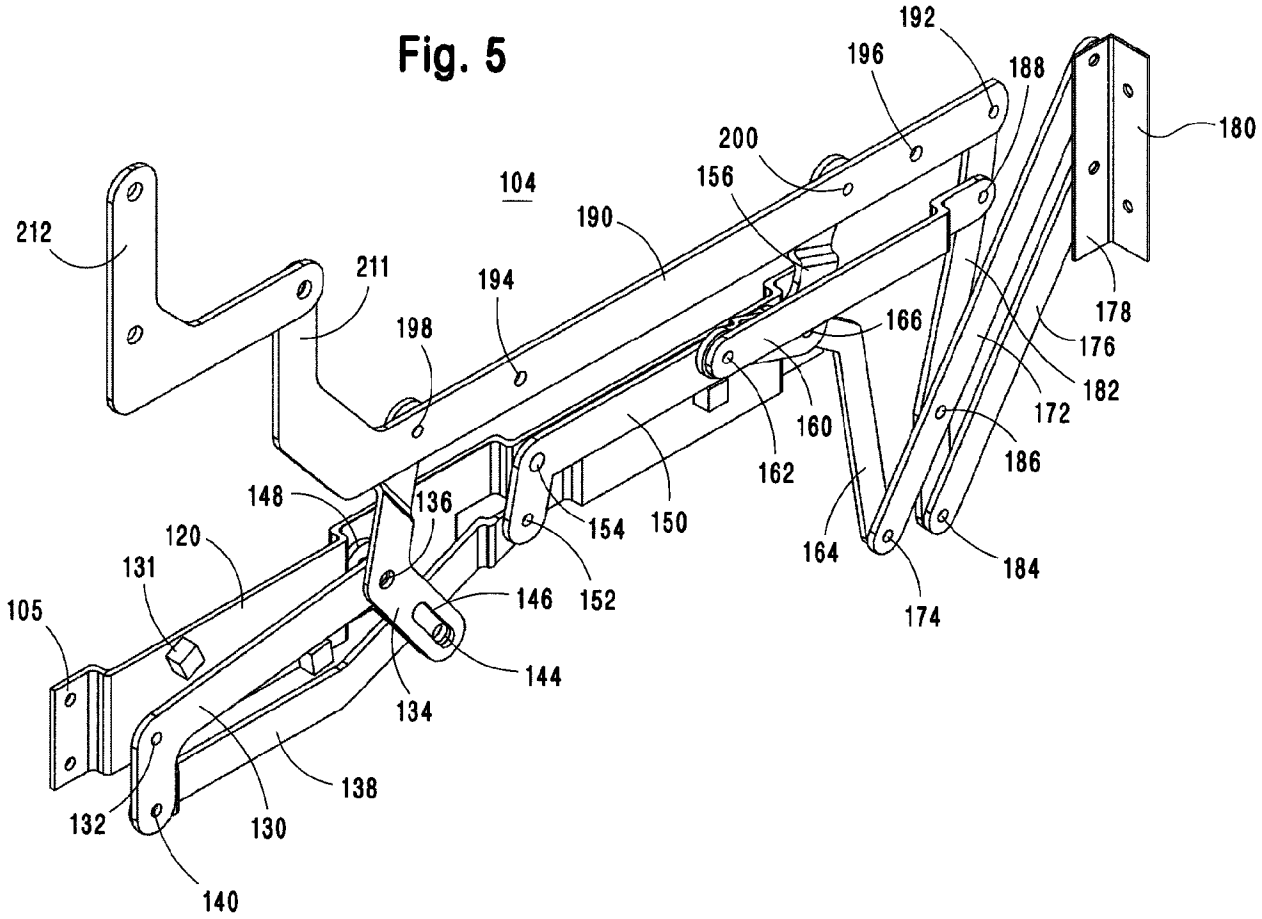
FIG. 5 is an isometric view of the recliner mechanism of the chair in a retracted position.
Figure 6:
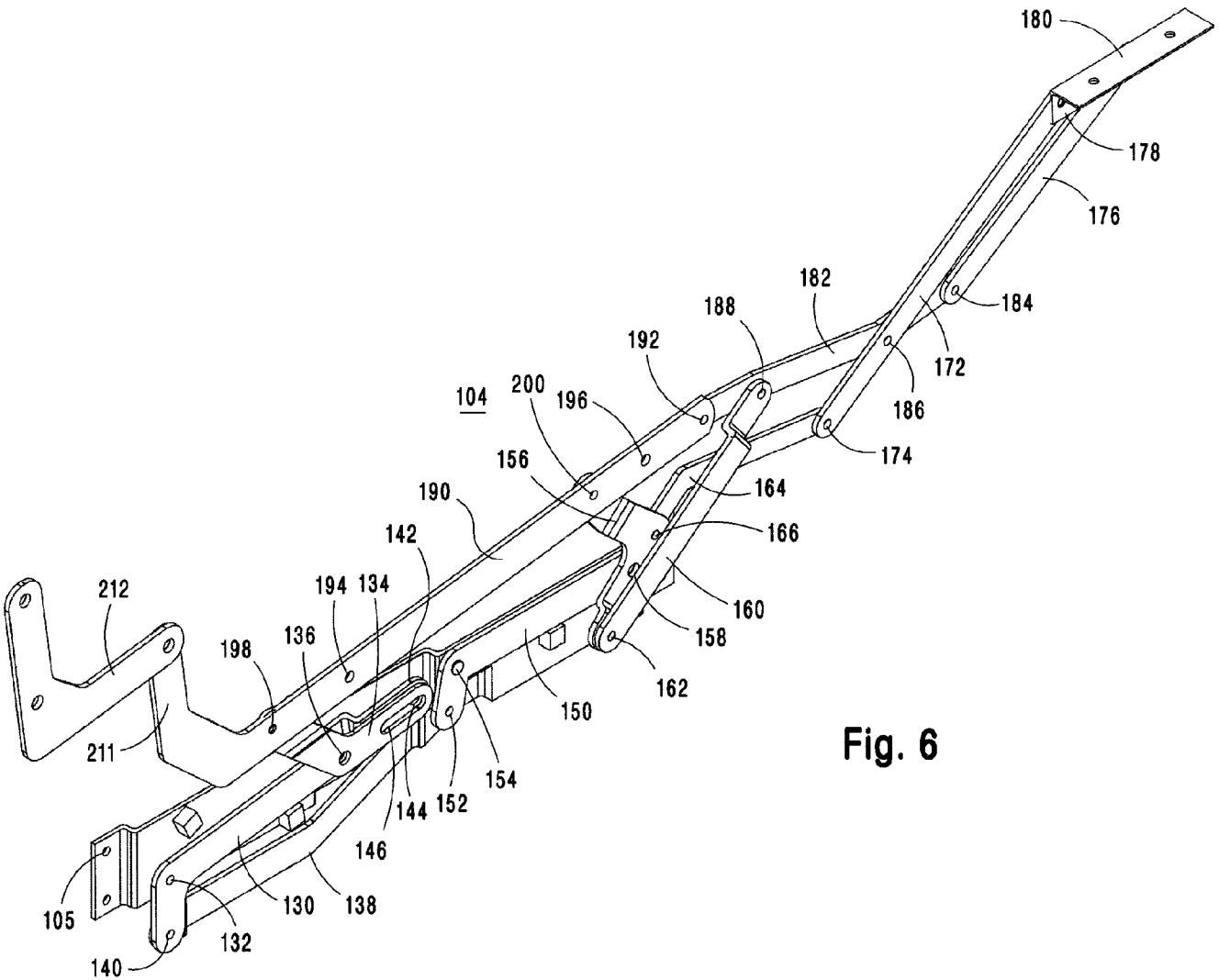
FIG. 6 is an isometric view of the recliner mechanism of the chair in an extended position.
Figure 7:
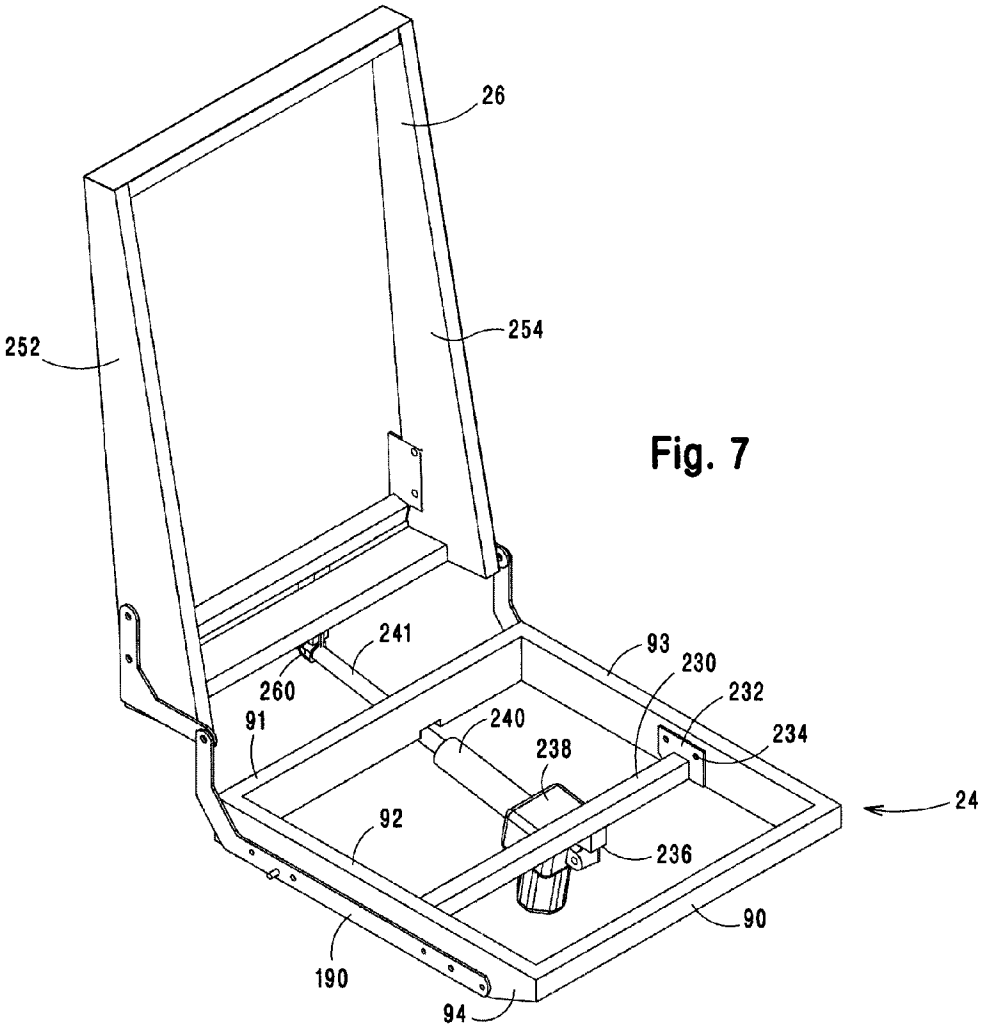
FIG. 7 is an isometric view from the left front showing the seat frame and back frame portions of the chair of the invention with the seat back motor or actuator connected and with the back frame in an upright position.

The details of the recliner linkage mechanisms 104 will now be described with particular reference to FIGS. 5-6, which illustrate the right side mechanism in a retracted and expanded position, respectively. It will be understood that the recliner mechanism shown in FIGS. 5-6 is designed to be placed on the left side of the chair, or the right side of chair 20 when viewed from the front, and further that the right side or the left side recliner mechanism when viewed from the front is comprised of identical operative parts arranged in mirror image. It will also be understood that the present invention may be used except where specifically indicated with other recliner mechanisms known in the prior art, and the invention is not meant to be limited to use with the described recliner mechanism.

FIG. 5 illustrates recliner mechanism 104 in a retracted position, while FIG. 6 illustrates recliner mechanism 104 in an expanded position. Before recliner mechanism 104 is attached to chair 20, however, as shown in FIGS. 22 and 23, arm frames 28 are operatively secured to lift assembly 22. More particularly, each arm frame 28 has a bottom side 110, a front post 112 (shown in FIG. 1), a rear post 114, an arm rest 116 extending between said front and rear posts, and side section 118 which connects between bottom section 110, front post 112, and rear post 114. Each arm frame 28 is secured to one of the C-shaped bar sections 62 and 63 which are part of the lift assembly 22, so that when the lift assembly is activated, the arm frames along with the rest of chair assembly 23 are lifted upwardly and pivoted or tilted forwardly. More particularly, in the present embodiment, apertures 65 and 66 are provided in C-shaped bar sections 62 and 63 (see FIGS. 2-3) through which apertures 65 and 66 screws or other connectors are passed directly into the underside of each arm frame bottom section 110. Recliner mechanisms 104 are then secured to the side sections 118 of arm frames 28 as described below.

Referring still to FIGS. 1, 22 and 23, recliner mechanism 104 includes an elongated arm frame connector plate 120 that is secured preferably by bolts or screws to the inner surface 122 of side section 118 of arm frame 28 through several apertures 105 on the ends and middle section of plate 120. A spacer block, not shown, may be provided between connector plate 120 and inner surface 122 of arm frame side section 118 to allow for use of slightly different sized frames. In addition, depending on the desired angle of the recliner mechanisms 104 with respect to seat frames 28, recliner mechanism 104 may be attached to the seat frame 28 at a slight angle. Referring also now to FIGS. 5 and 6, L-shaped link 130 is pivotably connected at 132 to arm frame connector plate 120 near the rearward end of such plate, and is pivotably connected to angled link 134 at 136. The end of L-shaped link 130 remote from pivot 136 is facing downwardly in FIG. 5 and is pivotably connected to link 138 at 140. Meanwhile, link 142, a portion of which is visible in FIG. 6 behind link 140, is pivotably and slidably connected to the lower end of angled link 134 at 144 in slide 146 in link 134, while link 142 is further pivotably connected on its other end to arm frame connector plate 120 at 148 (partially visible in FIG. 5 behind link 134). Link 138 is pivotably connected to another L-shaped link 150 at 152, which L-shaped link 150 is also pivotably connected to arm frame connector plate 120 at 154 and pivotably connected to angled link 156 at 158 (visible in FIG. 6). Angled link 156 is further pivotably connected to one end of straight link 160 at 162, and to one end of angled link 164 at 166. The other end of straight link 160 is pivotably connected to link 182 at 188, while the other end of angled link 164 is attached to the near end of footrest link 172 at 174. The far end of footrest link 172, as well as the far end of footrest link 176, are both connected to leg 178 of footrest bracket 180. The near end of footrest link 176 is connected to one end of link 182 at 184, while link 182 is further pivotably connected to footrest link 172 at 186, and, as indicated above, to straight link 160 at 188. Finally, link 182 is also pivotably connected at its rear end to seat frame connector plate 190 at 192, which plate 190, as shown FIG. 1 as well as in several of the other Figures, is bolted to the side sections 92 and 93 of seat frame 28 through apertures 194 and 196. Angled links 134 and 156 are also pivotably connected to seat frame connector plate 190 at 198 and 200, respectively, while plate 190 is also linked at its upwardly angled rear section 211 directly to L-shaped back frame connector link or bracket 212.

Figure 26:
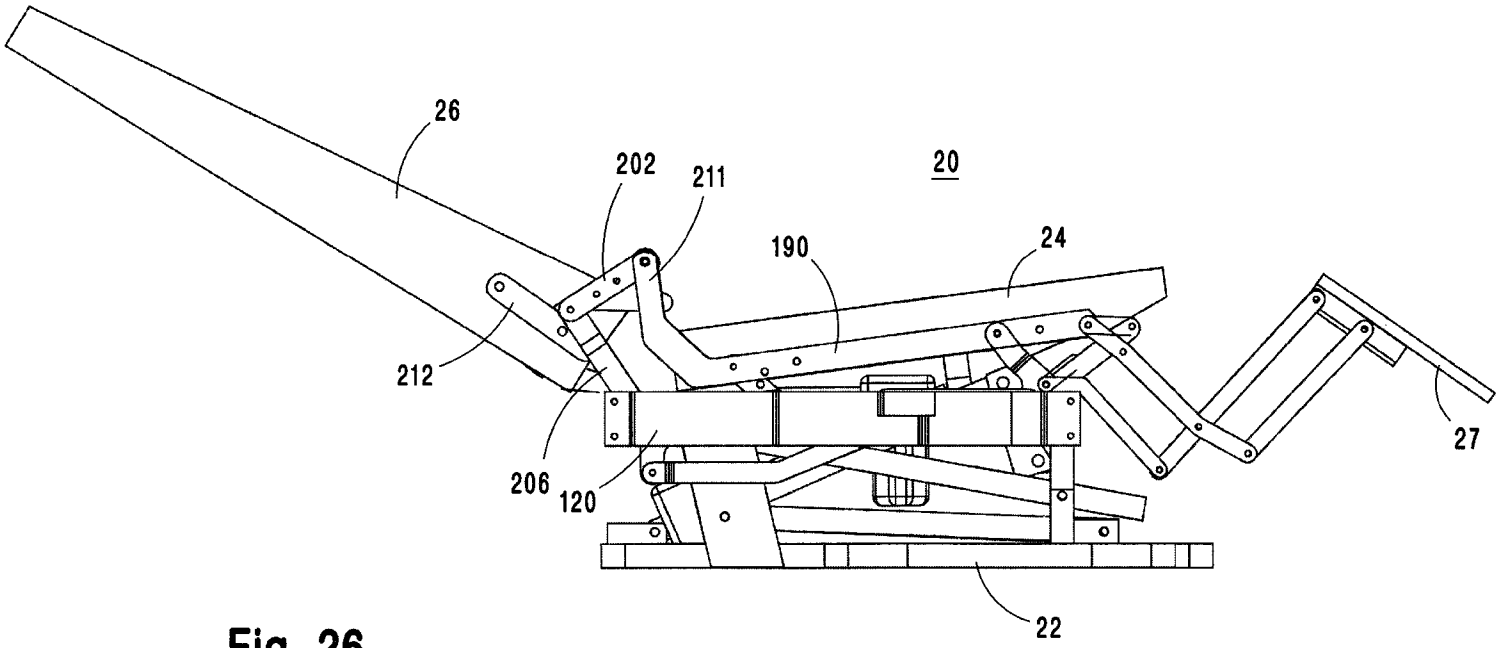
FIG. 26 is a side view of the chair shown in FIG. 25 in a zero-gravity position.
Figure 27:
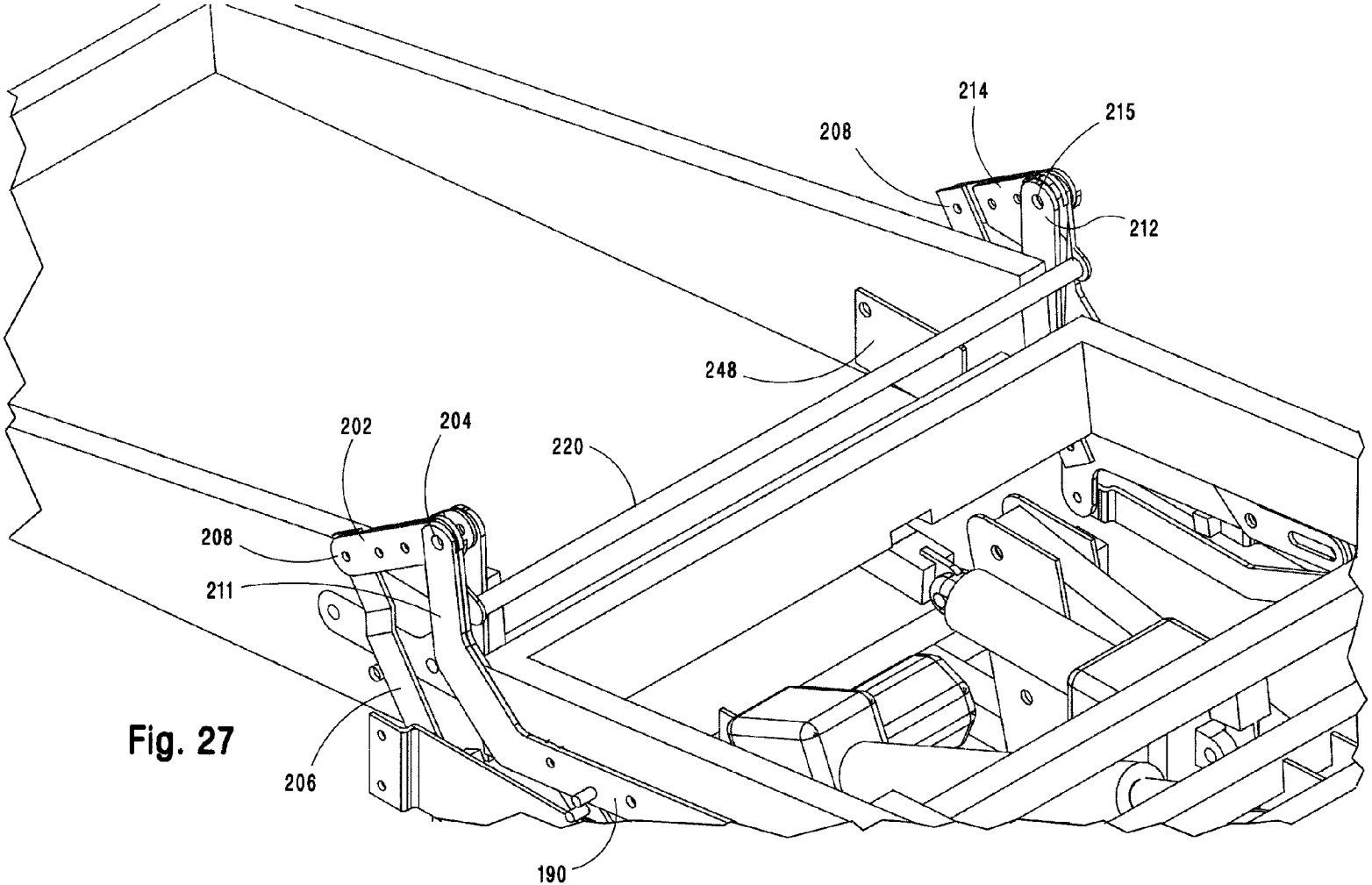
FIG. 27 is a partial front view of the back frame linkage mechanism of the chair shown in FIG. 25.
Figure 28:
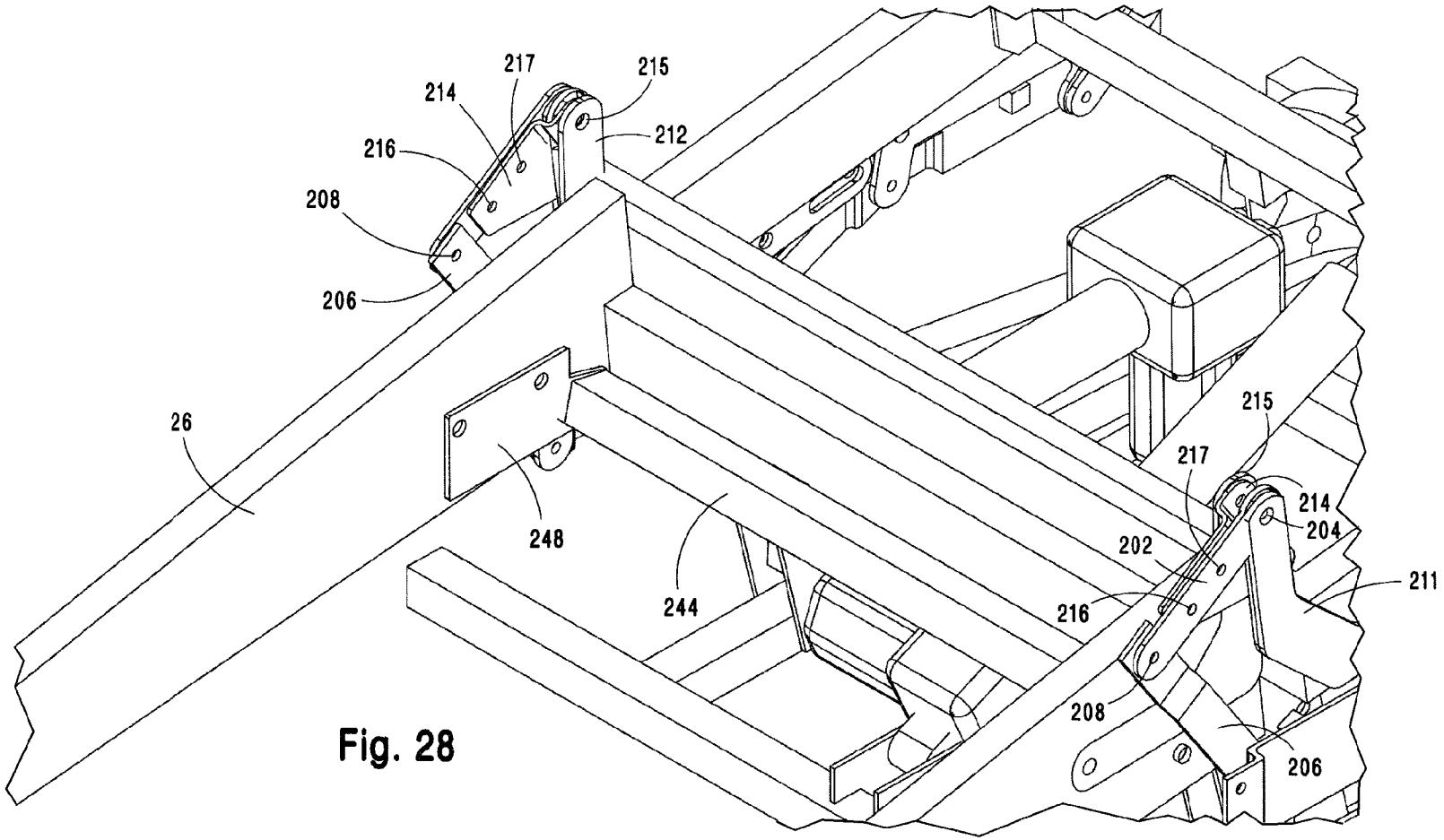
FIG. 28 is a partial rear view of the back frame linkage mechanism of the chair shown in FIGS. 25-27.

In an alternative and preferred link arrangement, shown in FIGS. 13 and 14, the upwardly bent or angled section 211 of seat frame connector plate 190 is pivotably joined to short link 202 and L-shaped link 212 at 204, while the opposite end of short link 202 is pivotably joined to straight link 206 at 208. Straight link 206 is then pivotably joined at its other end to the rearward end of L-shaped link 130 and therefore also to seat frame connector plate 120 at 132 (see FIG. 29) Such link arrangement has proven to result in a stronger and more stable connection between back frame 26, and L-shaped plate 212 and link mechanism 104. In a further preferred alternative link arrangement, illustrated in FIGS. 25-30, short link 202 is again, as in the embodiment shown in FIGS. 13 and 14, pivotably joined to the end of upwardly angled section 211 of seat frame connector plate 190 at 204, while short link 202 is also again joined at its opposite end to link 206 at 208. However, in such embodiment, link 204 does not also connect to L-shaped link 212, but instead, as is best illustrated in FIGS. 27 and 28, as well as in FIG. 30, another short link 214 is positioned behind link 202, which link 214 is pivotably connected to L-shaped link 212 at 215, and in addition is secured to link 202 at 216 and 217. In addition, as is visible in FIGS. 25, 27, 29, and 30, a bar 220 is provided connecting between the lower ends of links 214. The purpose of adding links 214 and bar 220 as described and shown is to add substantially to the overall strength of such linkage arrangement. As can be seen in the FIG. 29, links 214 are each nonpivotably joined at two points 216 and 217 to links 202, as well as to each other by bar 220, and pivotably to links 212 which connect chair back 26 to such linkage system. As a result of such linkage arrangement, a rigid box-like structure or framework is essentially formed around chair back 26, which structure substantially prevents any bending of any of the links that make up such mechanism from occurring, and therefore substantially increases the overall strength of the chair assembly 23. In another alternative embodiment, the arrangement shown in FIGS. 13 and 14 may be augmented with the addition of links 214 as shown in FIGS. 25-30 without, however, being connected together by crossbar 220. Such an intermediate strength mechanism may be suitable in chairs utilizing the linkage independently movable backrest arrangement of the invention wherein the additional strength provided by bar 220 is not required, such as in chairs having a lesser maximum weight limit or carrying capacity. Normally, however, it is believed that the additional strength provided by bar 220 will be most the most preferred structure. In addition, back frame 26, as shown below, will also be connected to seat frame 24 by the actuator mechanism including second motor or actuator 238.

The hollow rectangular bar 244 (see FIG. 12) may have one forward side omitted such that it can fit over the lower section of the backrest directly strengthening such lower section and when connected through fastenings between the plates 246 and 248 with L brackets or fittings 212 forming together with cross bar 220 and essentially rigid rectangular boxed in structure very securely reinforcing the lower end of the backrest plus the rear of the seat frame without massive structural sections on these parts, thus attaining superior strength and operation at only a minor increase in cost or weight while still retaining complete rotational movement of the seat back about a common axis and at the same time keeping the bar 220 completely out of the way with respect to pivoting of the back.

Figure 8:
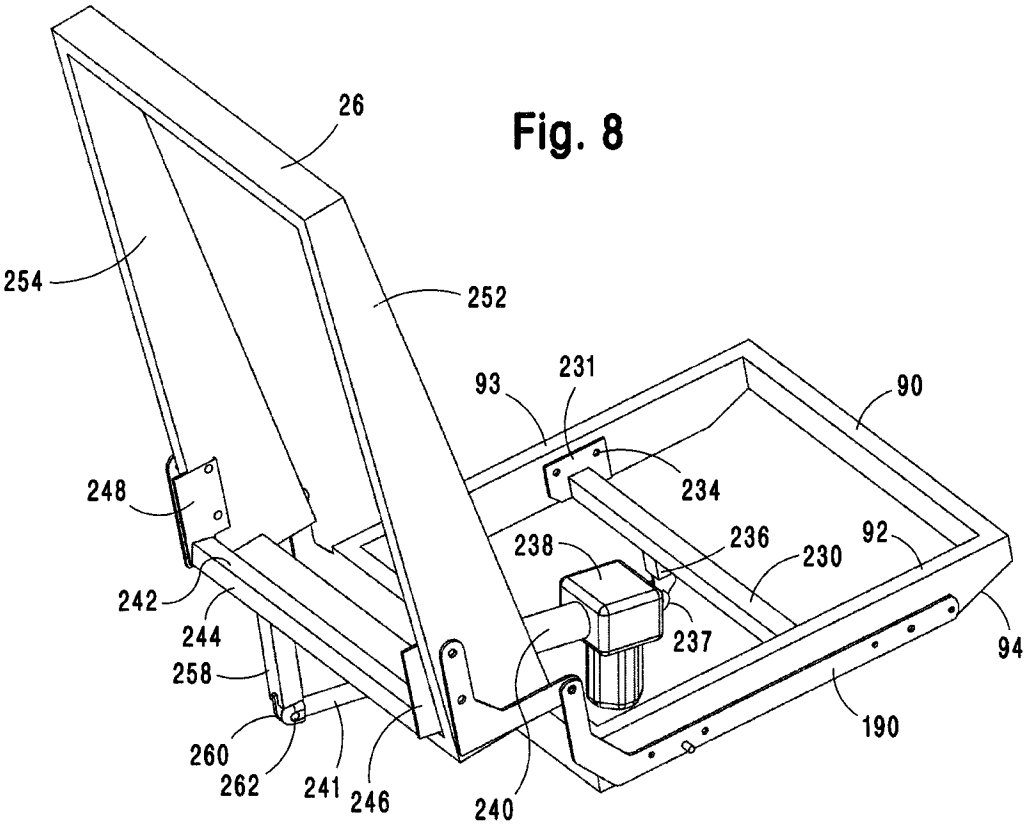
FIG. 8 is an isometric view from the right rear showing the seat frame and back frame portions of the chair of the invention with the seat back motor or actuator connected and with the back frame in an upright position as shown in FIG. 7.
Figure 9:
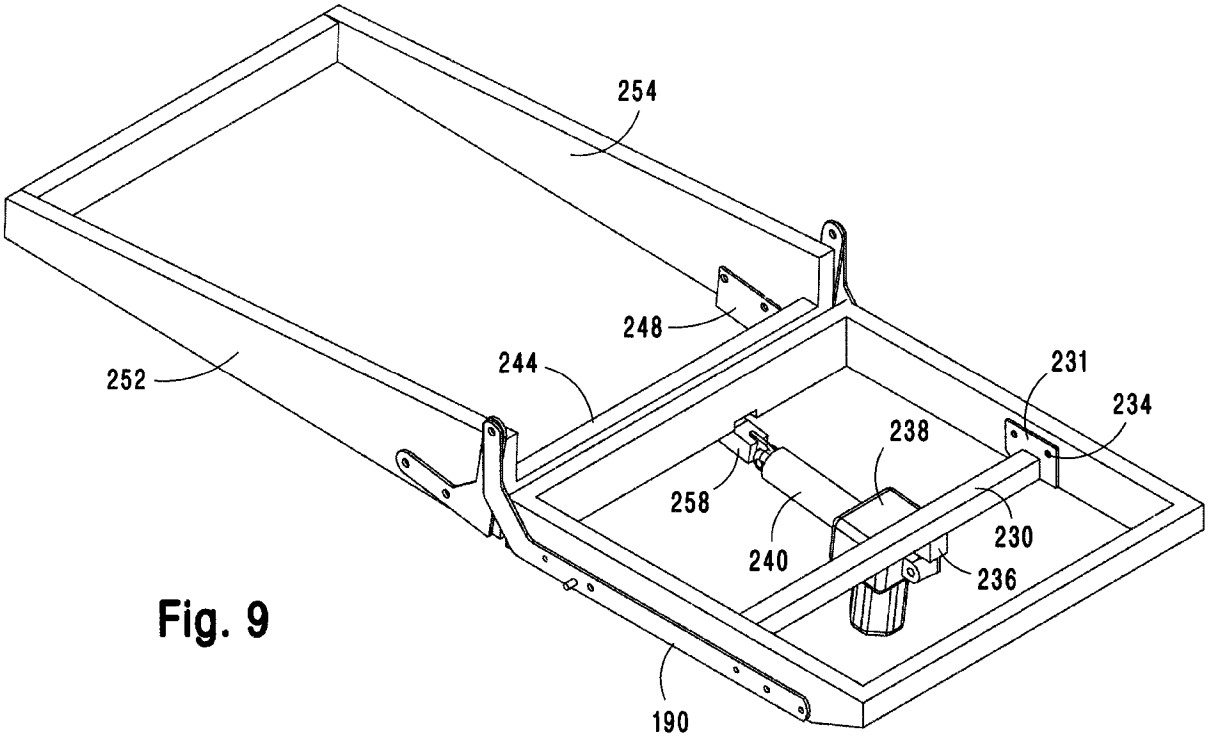
FIG. 9 is an isometric view from the left front showing the seat frame and back frame portions of the chair of the invention with the seat back motor or actuator connected and with the back frame in an reclined position.
Figure 10:
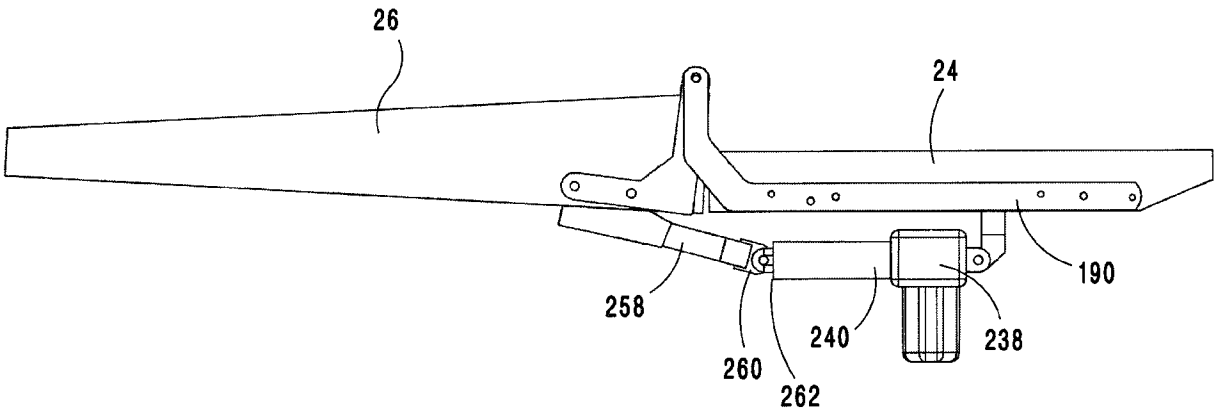
FIG. 10 is a side view showing the seat frame and back frame portions of the chair of the invention with the seat back motor or actuator connected and with the back frame in an reclined position.
Figure 11:
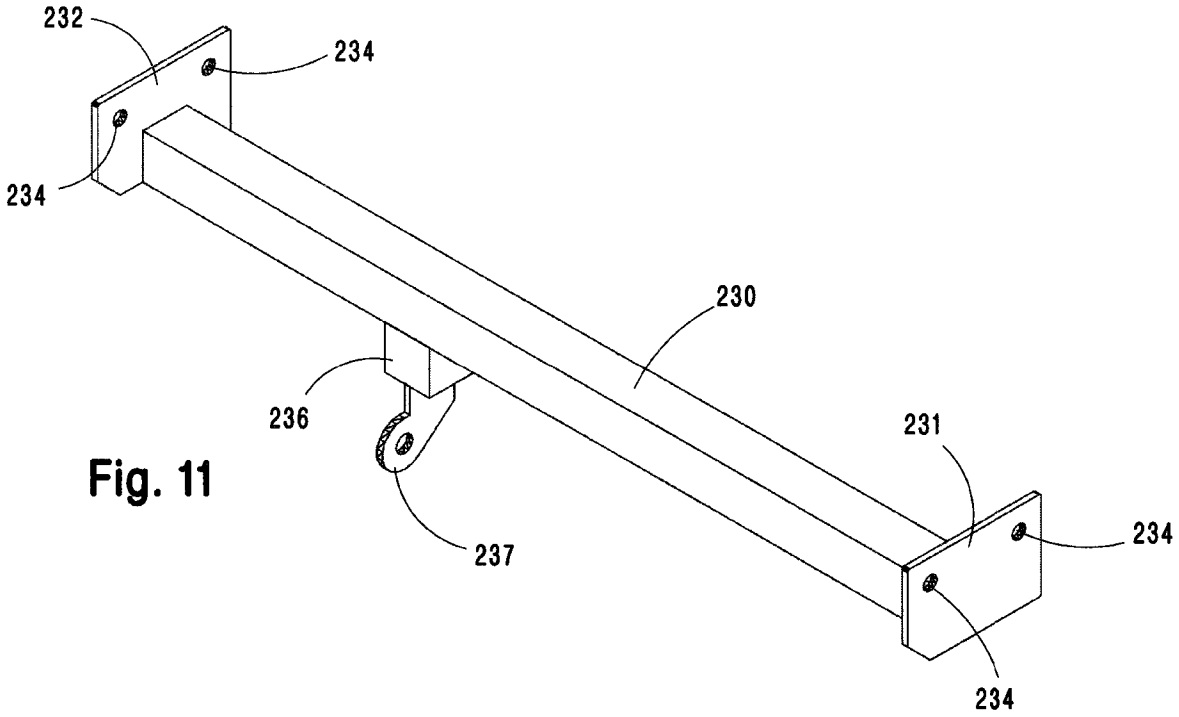
FIG. 11 is an isometric view of the bar for pivotably connecting the chair back motor or actuator assembly to the seat frame.
Figure 12:
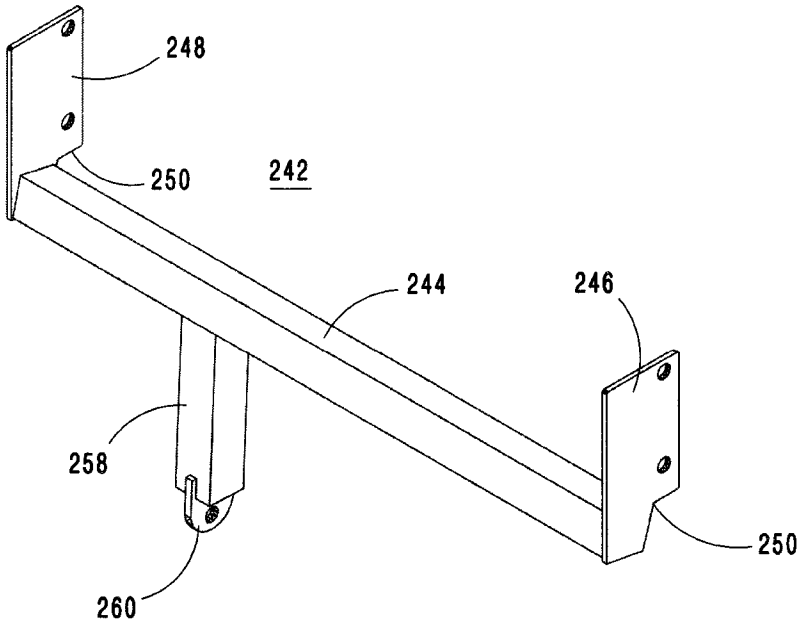
FIG. 12 is an isometric view of the back frame attaching bar for pivotably connecting the seat back motor or actuator to the seat back.

As indicated above, arm frame connector plate 120 of recliner mechanism 104 is bolted to the inner side surface 122 of side section 118 of arm frame 28, seat frame connector plate 190 is secured to seat frame 24, and back frame connector link or bracket 212 is secured to back frame 26 via one of the alternative linkage arrangement just described, thereby joining the seat frame 24, back frame 26, and footrest 27 together and forming chair assembly 23. The arrangement of the links of recliner mechanism 104 further allow the back frame 26 to pivot independent of the footrest 27 and seat frame 26. In addition, as will now be described with particular reference to in FIGS. 7-12, which are various perspective views of just the back and seat frame portions of chair 20, which frame portions may be joined together by the basic linkage arrangement shown in FIGS. 7-10, the alternative arrangement shown in FIGS. 13-14, or the second alternative arrangement shown in FIGS. 25-30, or the intermediate further alternative arrangement described above. In any case, attached generally in the vicinity of C-shaped bar 98 (see FIG. 4) extending between first and second side frame members 92 and 93 of seat frame 24 is seat frame motor or actuator attaching bar 230, which bar is preferably comprised of a hollow rectangular steel bar. Bar 230 is shown in perspective view in FIG. 11. Welded to the ends of bar 230 are plates 231 and 232 having apertures 234 for securing by bolts, screws, or the like bar 230 to seat frame side members 92 and 93. In addition, attached extending downwardly from bar 230, also preferably by welding, is connector 236 having ring-shaped aperture 237 to which seat back motor or actuator 238 is pivotably connected by a pin or the like (see FIGS. 7-10). Connector 236 is preferably situated slightly to one side of bar 230 so that motor or actuator 238 can lie or rest side-by-side with motor or actuator 74 described above, which motor is also slightly offset. Seat frame motor or actuator 238 is similar to footrest and lift motor or actuator 74 in that it also typically may be an electric motor that relatively rotates an internally threaded sleeve 240 and an externally threaded spindle 241 received therein to increase and decrease their combined overall length. The opposite end of internally threaded sleeve 240 is pivotably secured to back frame 26 via seat back motor attaching bar 242. Bar 242 is shown in perspective view in FIG. 12 and is preferably comprised of hollow rectangular steel bar 244 having plates 246 and 248 welded to its ends, the plates further having cutout sections 250 so that they can be secured along the inner sides of side sections 252 and 254 of back frame 26 as shown in FIGS. 8 and 9. Preferably, plate 246 is bolted or otherwise secured to side section 252 in combination with L-shaped back frame connector link 212 also on side section 252, while plate 248 is similarly bolted to side section 254 in combination with L-shaped back frame connector link 212 also on side section 254. Preferably attached by welding extending downwardly from bar 242 is short extension bar member 258, having ring 260 secured to its lower end of bar 258, so that the end of externally threaded spindle 241 may be pivotably secured to ring 260 via pin 262. A controller 280, shown in FIG. 24 and described in greater detail below, is then also operably connected both to lift frame and footrest motor or actuator 74 as well as seat frame motor or actuator 238 to control the overall movements of the chair frame.

Figure 15:
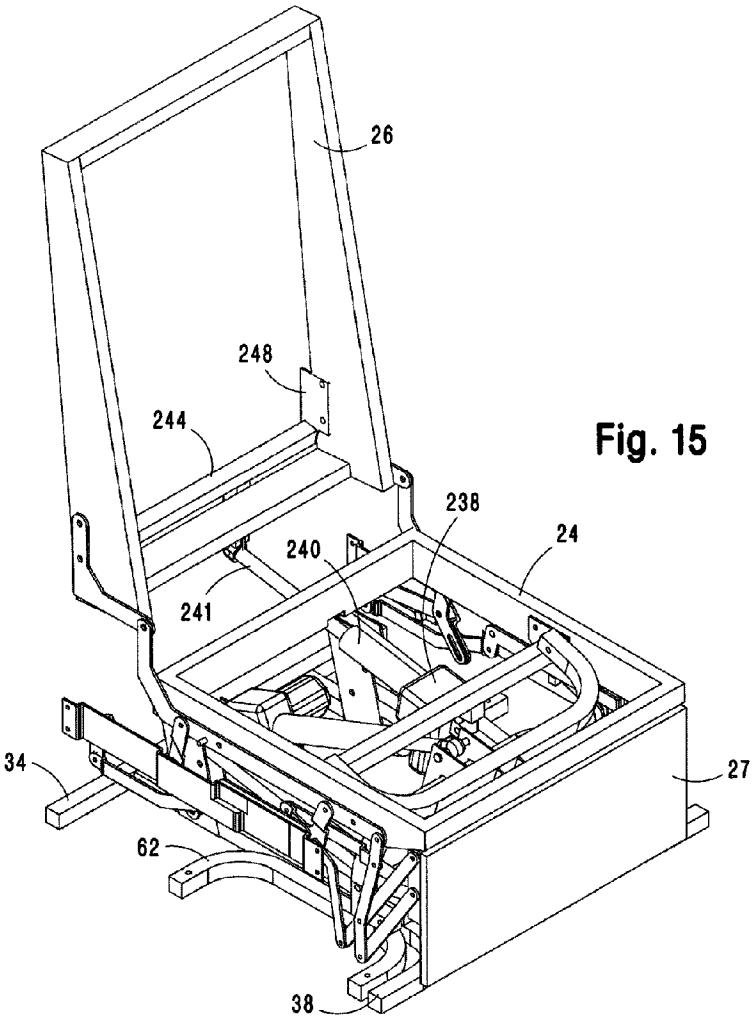
FIG. 15 is a left front perspective view of the chair of the invention in an upright or normal starting position showing the lift frame and recliner mechanism, with the chair arm frames and upholstery removed.
Figure 16:
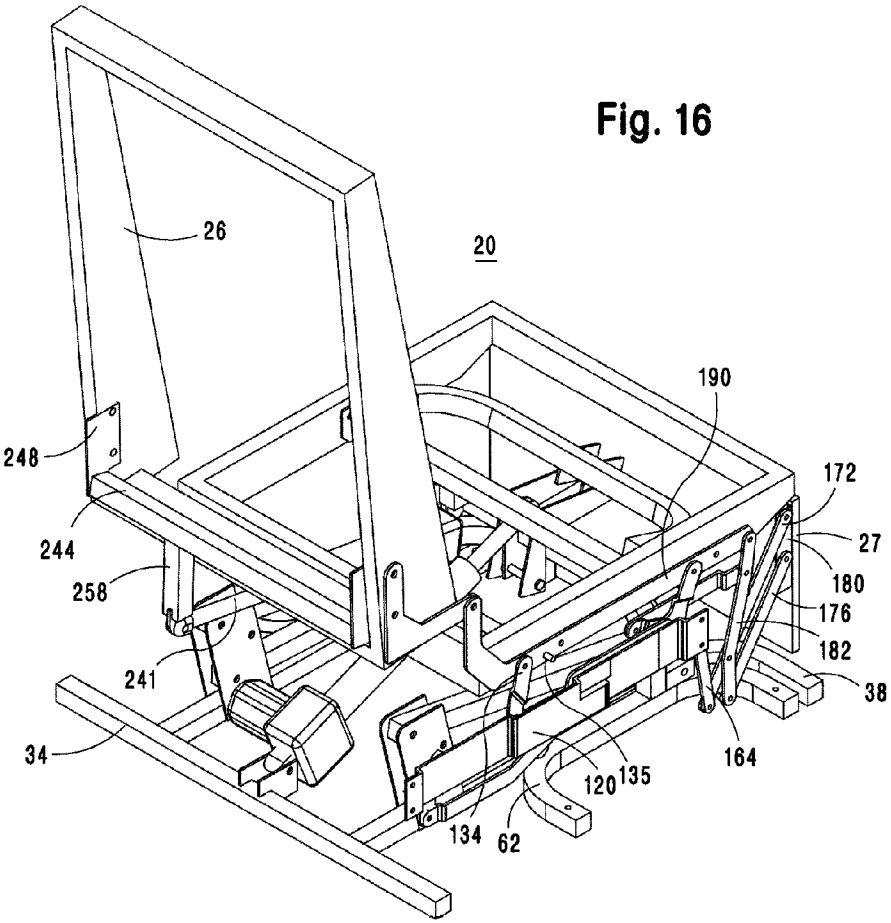
FIG. 16 is a rear perspective view of the chair of the invention in an upright or normal starting position showing the lift frame and recliner mechanism, with the chair arm frames and upholstery removed.
Figure 17:
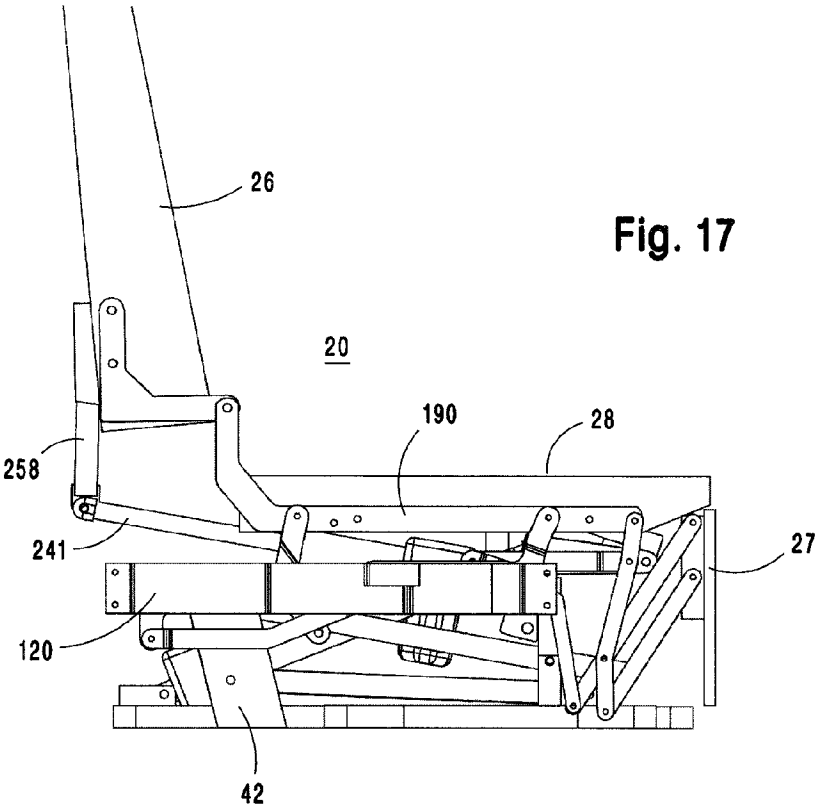
FIG. 17 is a side view of the chair of the invention in an upright or normal rest position showing the lift frame and recliner mechanism, with the arm frames and upholstery removed.

FIGS. 15-21 illustrate chair 20 of the invention in various different retracted or reclined positions. Such Figures do not include arm frames 28; however, the lift chair features of the invention are shown in FIGS. 22 and 23, where chair assembly 23 is shown supported on C-shaped pieces 62 and 63 in a lifted and forwardly tilted position. FIGS. 15-17 are front, back and side views of chair 20 in a fully upright position. When back frame 26 is in such an upright position, externally threaded spindle 241 of back actuator or motor 238 is extended from internally threaded sleeve 240. This is also evident in FIGS. 7 and 8, which show just the seat and back frame portions of the chair assembly, while in FIG. 9 as well as in FIGS. 1, 18 and 19, where back frame 26 is in a fully reclined position, internally threaded sleeve 240 in now rotated so externally threaded spindle 241 is screwed or threaded into it, so that it is effectively by retracting causing the back frame to recline. In addition, bar 258 is extending substantially directly downwardly from seat frame 26 when sleeve 240 rotates and spindle 241 is expanded out of it, and pivots forwardly when the seat frame 26 is reclined (see FIG. 19). Actuator 238 may also pivot slightly on bracket 236 attached to bar 230 to which actuator 238 is pivotably connected as the spindle 241 is moved in and out of sleeve 240 to move back frame 26. In addition, C-shaped bar sections 62 and 63 are supporting chair 20 or act to support the chair on the ground surface in addition to rear crossbar 34 and bars 38 and 39. Recliner mechanism 104 is also in retracted position, with footrest 27 inclined substantially vertical in relation to the ground surface and footrest links 164, 172, 176, and 182, which are connected in a scissors-like or so-called pantograph arrangement, being pivoted so that they are substantially more vertical than horizontal. Link 134 is also pivoted downwardly from seat frame connector plate 190, away from stop 135. Finally, as best shown in FIG. 2, threaded sleeve 75 is partially but not completely extended from spindle 76 when footrest 27 is completely retracted.

Figure 18:
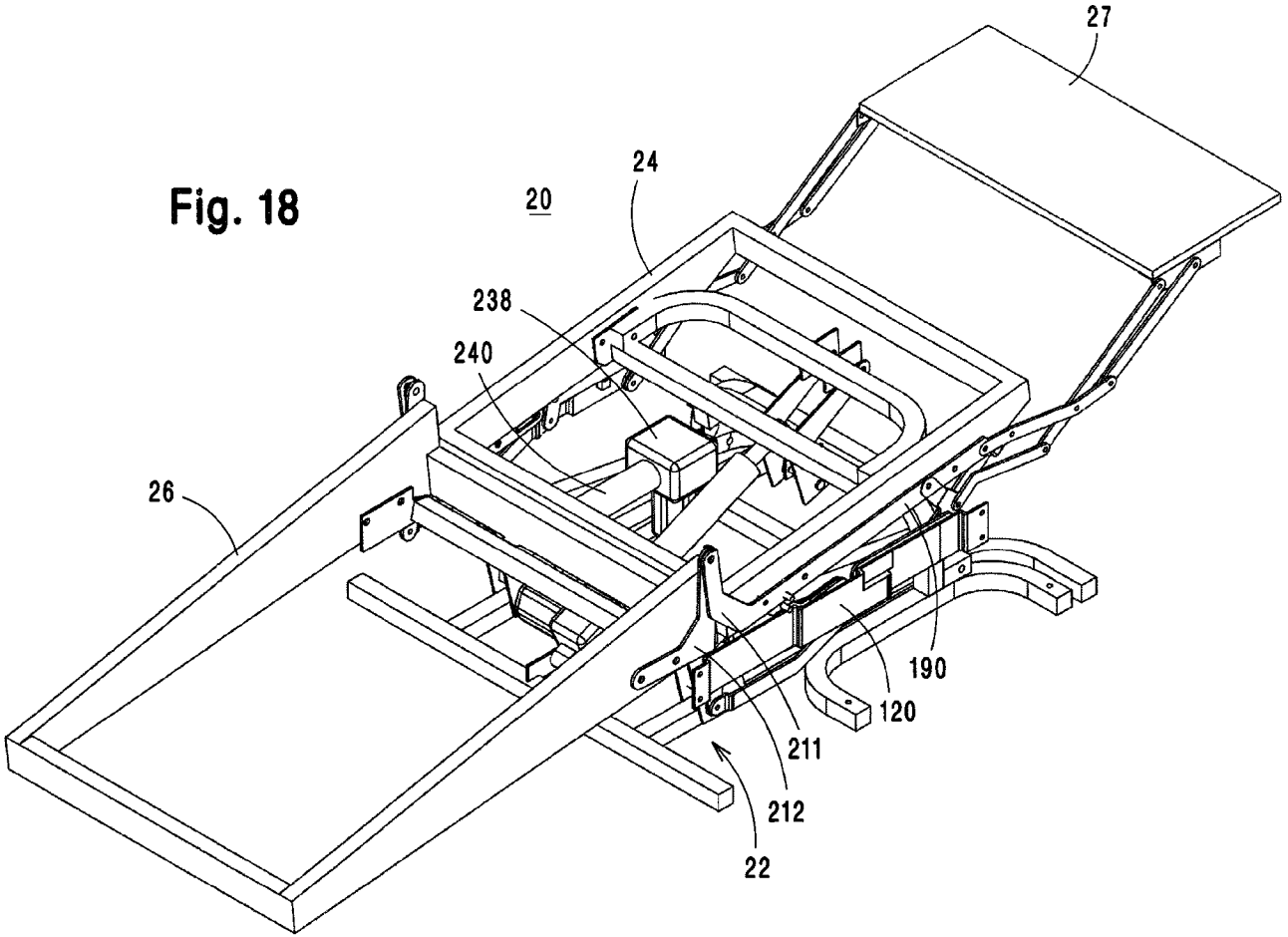
FIG. 18 is a right rear perspective view of the chair of the invention in a fully reclined position with the arm frames and the upholstery removed.
Figure 19:
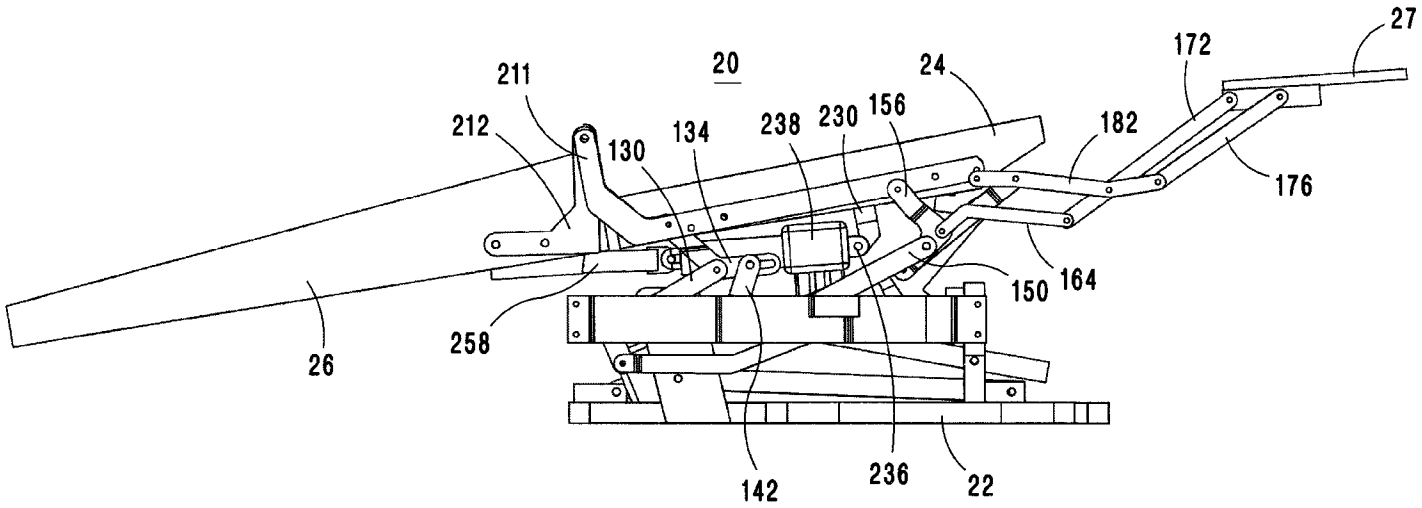
FIG. 19 is a side view of the chair of the invention in a fully reclined position with the arm frames and the upholstery removed.
Figure 24:
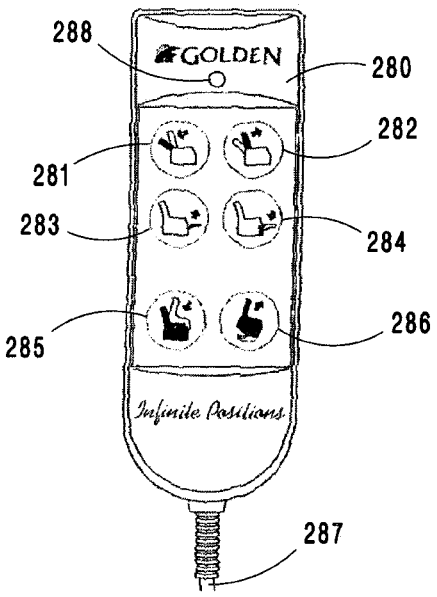
FIG. 24 is a plan view of a hand operated button type electrical controller for operation of the chair of the invention.
Figure 25:
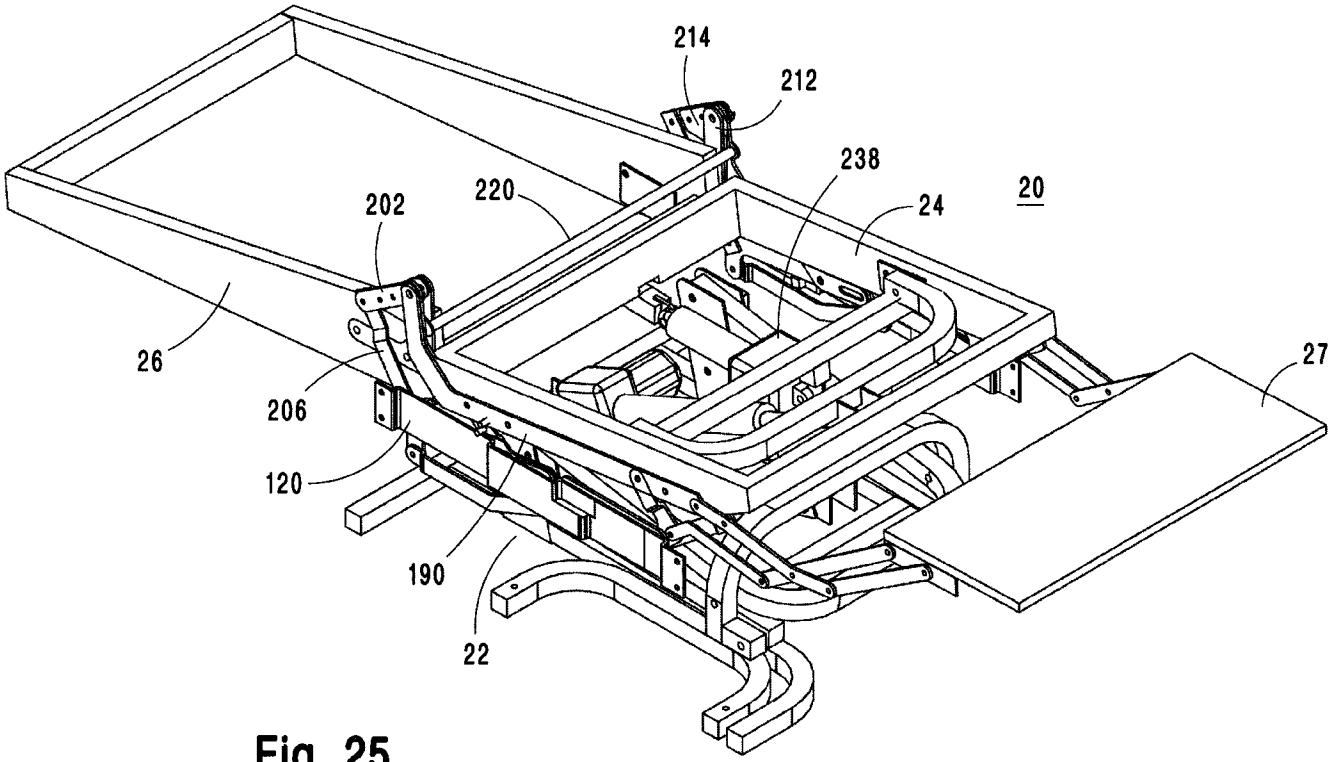
FIG. 25 is a front perspective view of another alternative embodiment of the chair of the invention.

When controller 280, shown in FIG. 24, is used to activate motor 74 to move the chair from an upright position shown in FIGS. 15-17 to a reclined position such as shown in FIGS. 1, 18, and 19, spindle 75 is retracted in sleeve 76, while L-shaped bracket 78 is pulled rearwardly along with spindle 75 by pivoting on pin 82 securing bracket 78 to bracket 80 on C-shaped section 64 of lift assembly 64. L-shaped bracket 78 also pulls C-shaped bracket 98, which in turn is connected to seat frame 24 and also puts tension on the seat frame to be pulled rearwardly. Seat frame 24, which is pivotably mounted to arm frames 28 by recliner mechanism 104, in turn is also pulled rearwardly, with links 134, 156, and 182 (as best shown in FIGS. 5 and 6) pivotably connected to seat connector plates 190 pivoting in a counterclockwise direction when viewed from arm frames 26 on pivot points 198, 200, and 192, respectively. Pivoting of link 156 also causes 160 and 164 to pivot forwardly, which movement further causes scissors style pivoting links 172, 176, and 182 to pivot with respect to one another, forcing footrest 27 to be pushed upwardly and outwardly away from the front of chair 20 until the footrest is in a substantially horizontal position. Thus, when motor 74 is activated, seat frame 24 is pulled rearwardly and footrest 27 is pushed upwardly and outwardly. At the same time, back frame 26 and electrical motor 238, which is pivotably attached to both seat frame 24 and back frame 26, moves rearwardly along with seat frame 24. Such feature is important to the operation of the invention as a whole, since if motor 238 was mounted stationary with respect to the lift frame or in some other manner, seat frame 24 could not move rearwardly without coming into contact with and damaging motor 238 or vice versa.

At approximately the same point at which footrest 27 reaches a substantially horizontal position, link 134 will have pivoted so that it is now prevented from further pivoting by stop 135, see FIG. 16. Thus, rather than seat frame 24 being pulled further rearwardly, the force continued to be applied by motor 238 now causes links 130, 142, and 150, as well as 160 to pivot upwardly, and for pivot 144 connecting link 142 to slide 146 in link 134 to move rearwardly in such slide 146. In particular, L-shaped links 130 and 150 are pivotably linked to opposite ends of link 138, so that such links will pivot or rotate in unison. See in particular FIG. 19. Such links will pivot upwardly until bar 130 has pivoted so that it is abutting stop 131, shown in FIG. 16, at which point further upward movement is prevented and spindle 75 is arranged so that it will be substantially completely retracted into sleeve 76, and the chair will have reached a fully reclined position. At the same time, the front end of seat frame will be moving on C-bracket 98, which pivots somewhat downwardly in response to further pulling on bracket 99 by such actuator 74. Again, motor 74 will simply move upwardly along with seat frame 24, so that motor 74 remains in substantially the same position relative to seat frame 24 at all times. Furthermore, back frame 26 can be moved to any pivoted position completely independently of the position of footrest 27 and seat frame 24. This feature is illustrated by comparing FIGS. 18-19, where back frame 26 is in a completely reclined position, with FIGS. 20 and 21, where back frame 26 is in an upright position. In all of such FIGS., footrest 27 and seat frame 24 are in a fully reclined position, while back frame 26 has been pivoted into either an upright or reclined position by actuator 238 which is controlled by controller 280. If desired, chair frame 23 could be moved to a lift position, wherein lift assembly 22 is extended as shown in FIG. 3 and chair frame 23 is lifted upwardly and tilted forwardly, while back frame 26 remains in a completely reclined position. In FIGS. 13 and 14, a fully reclined or bed-like position is also shown, with the difference being in the arrangement back frame 26 with respect to the linkage mechanism 104 which is stronger than the linkage shown with respect to the first embodiment of the invention. Similarly, in FIGS. 25 and 27-28, the chair with the back frame having a second alternative linkage system including stabilizing bar 220 is also in a fully reclined position. Such fully reclined position is essentially the Trendelenburg position, wherein the operator's legs are higher than his or her heart, which position is often desirable. However, the chair can also be moved to a reclining position, wherein the legs are not higher than the heart, either by not reclining the footrest mechanism all the way, or alternatively by pivoting the back frame upwardly, which will lift the occupant's torso upwardly. To return chair 20 to a non-reclined position, links 130 and 150 will pivot downwardly in a clockwise direction until they are prevented from further pivoting by stops 133 and 151, respectively. During this period, seat frame 24 and footrest 27 will be moving generally in a downward direction. Bar 98 will also pivot upwardly or forwardly as the seat frame is lowered. Once links 130 and 150 hit stops 133 and 151, respectively, the seat frame will move forwardly as the footrest 27 continues to be pulled inwardly towards chair 20 until it is again substantially vertical and seat frame 24 has returned to its original position.

Figure 20:
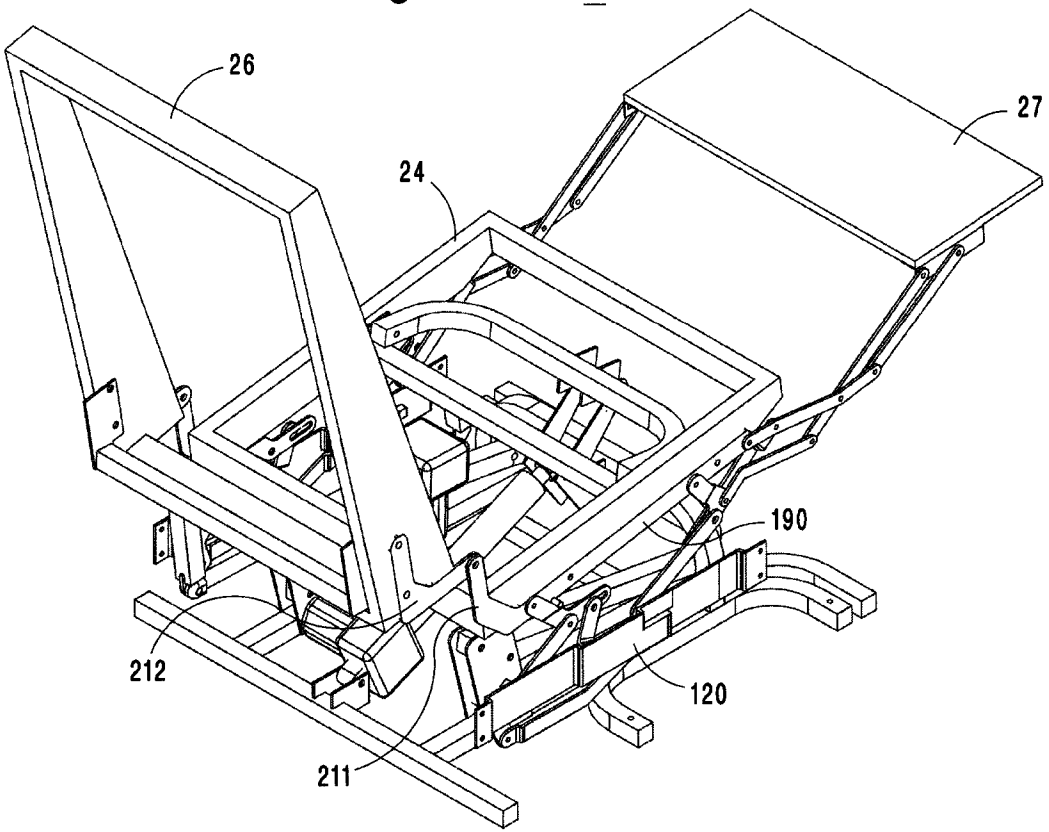
FIG. 20 is a right rear perspective view of the chair of the invention with the seat and footrest in a reclined position, but with the back frame in an upright position, with the arm frames and upholstery removed.
Figure 21:
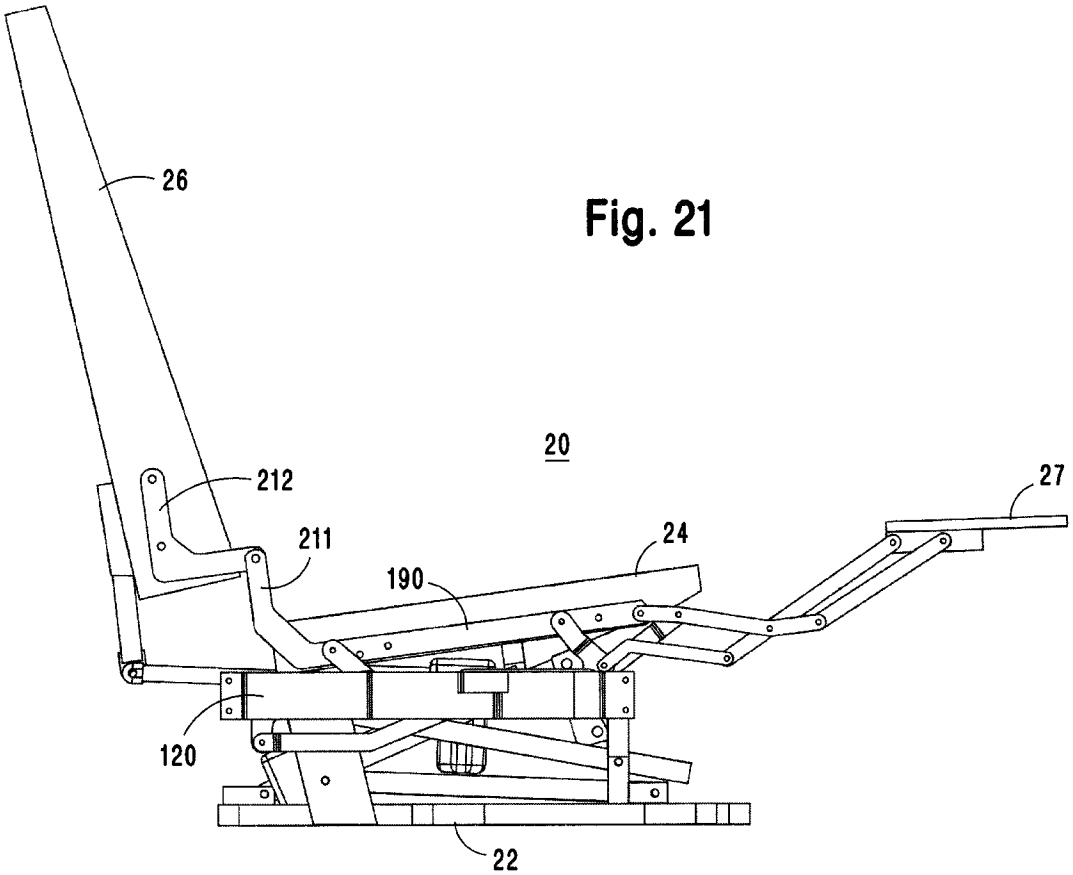
FIG. 21 is a side view or elevation of the chair of the invention with the seat and footrest in a reclined position, but with the back frame in an upright position, with the arm frames and upholstery removed.
Figure 29:
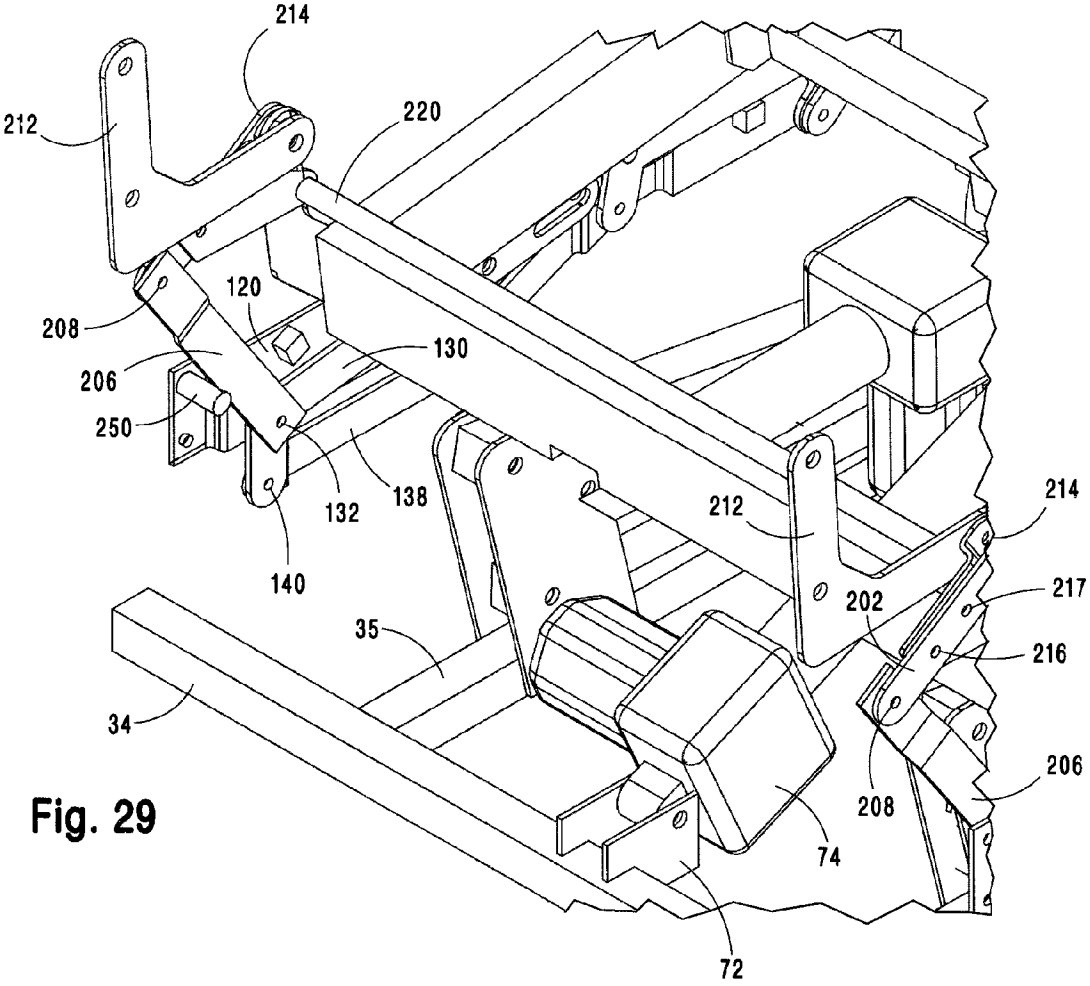
FIG. 29 is a partial rear view similar to FIG. 28 with the chair back frame removed and showing the stop means for adjusting the angle of the footrest slightly.
Figure 30:
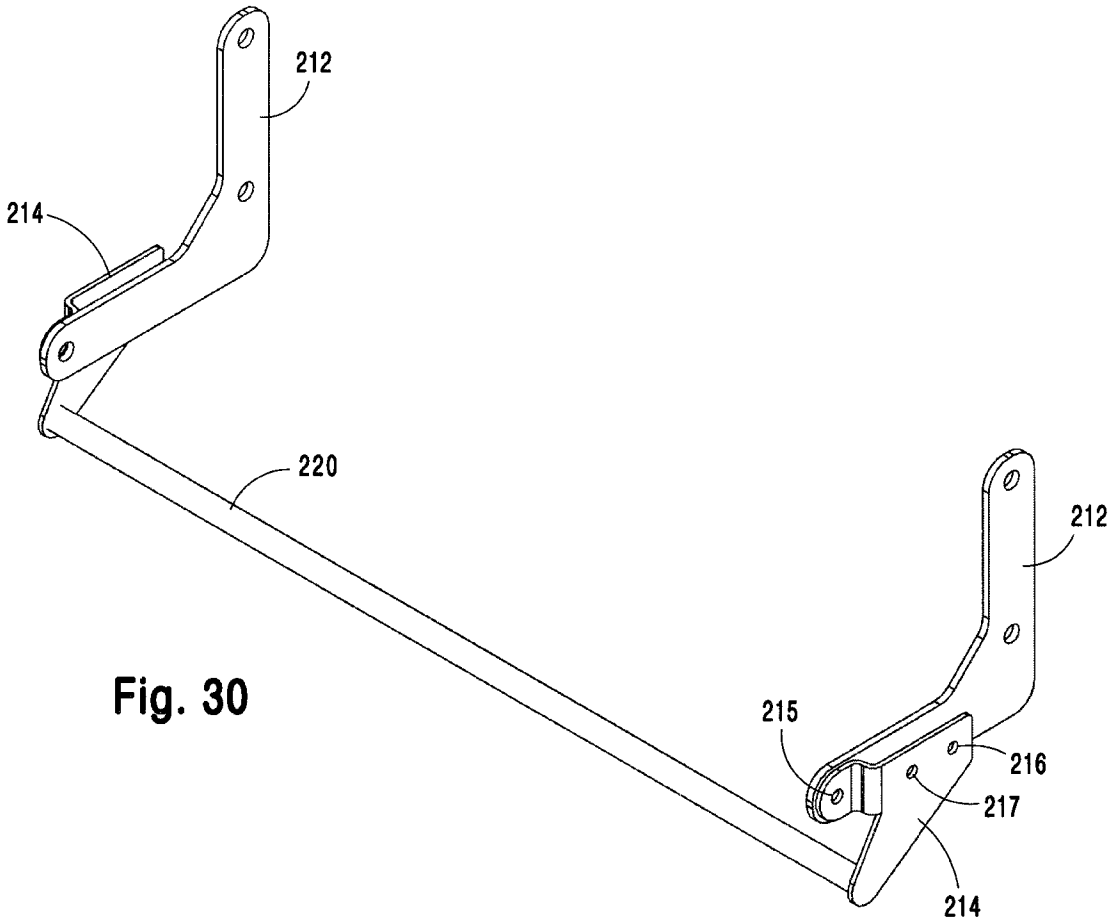
FIG. 30 is a perspective view of the improved alternative back frame linkage mechanism of the invention.

The ability of the seat frame to pivot rearwardly with the footrest results in a significantly more maneuverable and comfortable recliner and/or lift chair design than is available in the prior art. In chairs where the seat frame does not move in relation to the footrest, the resulting orientation is often uncomfortable for most users and furthermore it cannot be augmented to meet the comfort or medical needs of individual users. For example, as shown in FIG. 19, a person lying in chair 20 will be in the so-called Trendelenburg position, which is a position where such persons legs are higher than his or her heart. For persons who do not require or desire such a position, the back frame can be moved to a position such as shown in FIG. 20. In addition, as is shown in FIG. 26, the user may pivot the chair into a so-called "zero gravity" or back relief position, which provides complete support for the user and relieves pressure from the spine. Note in particular that in FIG. 26, the footrest is not completely horizontal but is at a slight forward incline or angle. In another novel feature of the invention, the present inventors have conceived of a simple yet extremely effective means for adjusting the angle of the footrest based on the desires and needs of individual purchaser of chair 20. Normally, when the chair is being moved to a reclining position, as explained above, the footrest 27 will move upwardly and the chair seat frame 24 will move rearwardly on linkage mechanism 104 until the footrest has reached approximately a horizontal position. However, as is best shown in FIG. 29, stop 250 is positioned extending inwardly from the rear edge of seat frame connector plate 120. As a result, just before footrest 27 reaches a horizontal position, link 206 will move rearwardly into contact with stop 250, which will prevent the linkage mechanism from further rearward movement, and footrest 27 will be deployed at an angle that is slightly less than horizontal. It should be evident, therefore, that by replacing stop 250 with a similar stop having either a slightly greater or slightly reduced diameter, the angle at which footrest 27 ultimately comes to rest can be adjusted slightly. The use of stop 250 provides a simple and effective means for enabling the footrest to be slightly inclined, and so as a result chair 20 can also be adjusted so that it is in substantially a zero-gravity position, such as that shown in FIG. 26, wherein all of the weight of the chair occupant has been relieved from the spine, and the body is essentially in a stress-free position. Depending upon the physical characteristics of an individual user of chair 20, the zero-gravity position may be slightly different, and thus the ability to adjust the angle of the back frame 26 independent of the position of both the seat frame and footrest, plus the ability to slightly adjust the angle of the footrest accordingly by changing the diameter of stop 250, a more user-friendly and easily adjustable lift and recliner comprising a substantial advance in the art has resulted.

The controller 280 provided to control or activate motors 74 and 238, shown in FIG. 24, may be of a conventional type, and preferably will have separate buttons for reclining the seat back 281, moving the seat back to an upright position 282, moving the chair to a reclining position with the footrest extended 283, moving the footrest to a retracted position 284, activating the lift assembly so that the chair frame is raised and tilted forwardly 285, and for returning the lift assembly to a retracted position 286. Wire 287 connects controller 280 to the actuators, although a wireless connection may also be used if preferred. A light means 288 may also be provided to indicate activation or multiple light means could be provided to indicate modes of operation.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A combination lift chair and recliner comprising:

(a) a base for support of the combination chair in all positions, (b) a lift frame mechanism, (c) a chair frame arrangement including a chair seat section, a back section, and a footrest section, (d) a pantograph-type combined linkage mechanism securing the chair seat section, back section and footrest section together in a movable relation with respect to each other, (e) linkages enabling a first motor to operate the inclination of the back section independent of the movement of the other two sections, said first motor being pivotably connected to the chair seat section via a substantial brace secured to the seat section and pivotably connected to the back section via a substantial lever structure secured to the back section so as to remain in the same relative position with respect to said chair seat section as the chair seat section is moved, and (f) a second motor arranged by linkages to operatively elevate the footrest section and move the seat section rearwardly by lever linkage driving a first interval of operation, followed by an elevation of the footrest section and seat section in a second interval of operation of said motors operational movement, and to place the chair frame in a lift position at the other end of the allowed movement of the second motor;

(g) said chair section and back section being directly rotationally pivoted to each other; and (h) the pivoting connection between the chair seat section and the back section being provided on both lateral sides of the seat and back sections, and a brace and connecting bar extending laterally between the two to form a rigid connection.

2. A combination lift chair and recliner in accordance with claim 1 wherein the lever structure secured to the back section includes a metal lateral brace having metal side plates mounted on its ends which are secured to the back section, in effect forming a rigid boxed bracing arrangement to maintain said back section substantially rigid and reducing flexure or bending tending to weaken and damage the back section.

3. A combination lift chair and recliner comprising:

(a) a base for support of the combination chair in all positions, (b) a lift frame mechanism, (c) a combined chair frame arrangement including a chair seat section, a back section, and a footrest section, (d) a combined linkage securing the chair seat section, back section and footrest section together in a movable relation with respect to each other, which combined linkage is a pantograph-type linkage, (e) a first motor arranged by linkages to operate the inclination of the back section independent of the movement of the other two sections, said first motor being pivotably connected to the chair seat section of said chair so as to move along with said chair seat section as the chair seat section is moved;

(f) a second motor arranged by linkages to operatively elevate the footrest and move the chair between a reclining position and lift position;

(g) said chair section and back section directly rotationally pivoted to each other; and (h) a size-adjustable stop positioned on a support bar of the pantograph-type linkage such that during movement of the chair between an upright and reclining position the final angle of the footrest in relation to the seat frame can be adjusted upon impingement of a link of the pantograph-type linkage against the stop.

4. A combination lift chair and recliner in accordance with claim 3 wherein the stop is adjustable to provide a zero gravity position customized for a particular body size and conformation of a user of the chair.

5. A recliner chair comprising:

(a) a base for support of the chair in all positions, (b) a chair frame arrangement including a chair seat section, a back section, and a footrest section, (c) linkages securing the chair seats section, back section and footrest section together in a movable relation with respect to each other, which linkages include a pantograph-type linkage, (d) linkages enabling a first motor to operate the inclination of the back section independent of the movement and position of the seat and footrest sections, said first motor pivotably connected to the chair seat section so as to move along with the chair seat section at all times, (e) a second motor arranged by linkages to operatively elevate the footrest section and move the seat section between a seated position and a reclining position, (f) said chair section and back section being directly rotationally pivoted to each other; and (g) the linkages enabling the first motor to effect the inclination of the back section including a lever structure secured to the back section and a support secured to the seat section.

6. A recliner in accordance with claim 5 wherein the linkages connecting the seat section and back section together in a movable relation are provided on both lateral sides of the seat and back sections and a brace and connecting bar extends laterally between the two to form a rigid connection.

7. A recliner in accordance with claim 6 wherein the lever structure secured to the back section is attached to a metal cross brace on the back section which is displaced from the lower end of the back section and secured via metal cross links to the cross bar section in effect forming a rigid boxed bracing arrangement about the end of the back section to maintain such section substantially rigid at all times eliminating flexure or bending tending to weaken and damage the seat section.

8. A recliner chair comprising:

(a) a base for support of the chair in all positions, (b) a combined chair frame arrangement including a chair seat section, a back section, and a footrest section, (c) a combined linkage securing the chair seat section, back section and footrest section together in a movable relation with respect to each other, (d) a first motor arranged by linkages to operate the inclination of the back section independent of the movement of the chair seat and footrest sections, said first motor pivotably connected to the chair seat section, (e) a second motor arranged by linkages to operatively elevate the footrest and move the chair between a reclining position and an upright position, the chair side and back sections being directly rotationally pivoted to each other, and (f) a stop provided on the end of a support for the pantograph-type linkage the position of which stop can be varied, whereby the operation of the pantograph linkage for moving the chair from an upright position to a fully reclined position can be stopped by impingement of a link of the combined linkage against the stop in a zero gravity arrangement of the seat and footrest.

9. A combination lift chair and recliner in accordance with claim 8 wherein the stop is adjustable to provide a zero gravity position customized for a particular body size and conformation of a user of the chair.

10. A combination lift chair and recliner comprising:

(a) a base for supporting the combination chair in all positions;

(b) a lift and recline mechanism operably secured to said base for moving the combination chair between lift and recline positions;

(c) a chair assembly including a seat frame, a back frame, a pair of arm frames, and a footrest;

(d) linkage mechanisms securing the seat frame, back frame, arm frames, and footrest in a movable relation, said linkage mechanisms including a pantograph linkage;

(e) an actuator assembly operably connected to the combination chair between the seat frame and back frame for effecting inclination of the back frame independent of the position of the seat frame or footrest;

(f) another actuator assembly operably connected to the combination chair for effecting movement of the chair assembly between a lift position and a reclining position; and (g) a control device operably connected to the actuators, (h) wherein during operation of the actuator assembly for effecting movement of the chair assembly, the actuator assembly for effecting movement of the back frame can be simultaneously operated to adjust the inclination of the back frame.

11. A combination lift chair and recliner in accordance with claim 10 in which the seat frame and back frame are directly rotationally pivotable with respect to each other.

12. A combination lift chair and recliner in accordance with claim 10 in which the actuator assembly for effecting independent inclination of the back frame is pivotably connected to the combination chair so as to move with the seat frame when the seat frame is moved by operation of said other actuator assembly.

13. A combination lift chair and recliner in accordance with claim 12 additionally comprising an attachment bar mounted to the back frame, said actuator assembly for effecting inclination of the back frame being pivotably secured to said attachment bar.

14. A combination lift chair and recliner in accordance with claim 13 additionally comprising a bar member secured to the seat frame, said actuator assembly for effecting inclination of the back frame being pivotably connected to said bar member.

15. A combination lift chair and recliner in accordance with claim 14 in which the bar member is mounted extending between a pair of opposite frame members of the seat frame.

16. A combination lift chair and recliner in accordance with claim 15 in which the actuator assembly for effecting inclination of the back frame remains in the same relative position with respect to the seat frame when the seat frame is moved by operating said other actuator assembly.

17. A recliner chair comprising:

(a) a base for support of the chair in all positions, (b) a recline assembly connected to the base, (c) a chair assembly including a chair seat section, back section, pair of arm rests, and a footrest section, (d) a pair of linkage mechanisms interconnecting the chair seat section, back section, arm rests, and footrest section in a movable relation with respect to each other, and the linkage mechanisms including a pantograph linkage, (e) a first motor assembly, (f) a second motor assembly, (g) linkages enabling the first motor assembly to operatively move the chair by lever linkage between a reclined position and an upright position, and (h) linkages enabling the second motor assembly to operatively adjust the inclination of the back section without regard to the position of the chair assembly, and enabling the second motor assembly to move along with said chair seat section when the chair seat section is moved by operating the first motor assembly.

18. An infinite position lift and reclining chair comprising:

(a) a base;

(b) a lift and recline assembly connected to the base;

(c) a seat frame;

(d) a back frame;

(e) a leg rest;

(f) linkages interconnecting the seat frame, back frame, and leg rest, including a pantograph linkage;

(g) a lift-recline actuator operably connected to the base on one end and to the lift assembly and seat frame on the other end for moving the chair between a lift position in which the seat frame is lifted forwardly upwardly and a reclined position; and (h) a back frame actuator operably connected to the back frame, said back frame actuator when activated without simultaneous activation of the lift-recline actuator enabling the angle of the back frame relative to the seat frame to be adjusted throughout the range of motion allowed for by the back frame actuator, and being connected to the seat frame such that as the seat frame is moved by operating the lift-recline actuator, the back frame actuator moves along with the seat frame.

19. The chair of claim 18 additionally comprising a controller operably connected to the lift-recline actuator and back frame actuator.

20. The chair of claim 19 in which the back frame actuator is pivotably connected between the seat frame and back frame by separate brackets attached to the seat frame and back frame.

21. The chair of claim 19 in which the back frame actuator is pivotably connected between the seat frame and back frame by brackets connected indirectly to the seat frame and back frame.

22. The chair of claim 21 additionally comprising a bar member attached to the seat frame, said bar member having a bracket to which the back frame actuator is pivotably connected.

23. The chair of claim 22 additionally comprising an attachment bar secured to the back frame to which the back frame actuator assembly is pivotably connected.

* * * * *